US009304417B2

(12) United States Patent
Shibata et al.

(10) Patent No.: US 9,304,417 B2
(45) Date of Patent: Apr. 5, 2016

(54) ELECTROPHOTOGRAPHIC PHOTORECEPTOR, ELECTROPHOTOGRAPHIC IMAGE FORMING APPARATUS AND PROCESS CARTRIDGE

(71) Applicant: Konica Minolta, Inc., Tokyo (JP)

(72) Inventors: Toyoko Shibata, Zama (JP); Seijiro Takahashi, Kokubunji (JP)

(73) Assignee: KONICA MINOLTA, INC., Tokyo (JP)

( * ) Notice: Subject to any disclaimer, the term of this patent is extended or adjusted under 35 U.S.C. 154(b) by 43 days.

(21) Appl. No.: 14/304,474

(22) Filed: Jun. 13, 2014

(65) Prior Publication Data

US 2014/0377694 A1 Dec. 25, 2014

(30) Foreign Application Priority Data

Jun. 21, 2013 (JP) ..... 2013-130328

(51) Int. Cl.

| | |
|---|---|
| ***G03G 5/00*** | (2006.01) |
| ***G03G 5/147*** | (2006.01) |
| ***G03G 5/06*** | (2006.01) |

(52) U.S. Cl.

CPC ..... *G03G 5/14704* (2013.01); *G03G 5/0614* (2013.01); *G03G 5/0668* (2013.01); *G03G 5/0672* (2013.01); *G03G 5/14708* (2013.01); *G03G 5/14717* (2013.01)

(58) Field of Classification Search

CPC ..... G03G 5/0614; G03G 5/14704; G03G 5/14708

USPC ..... 430/58.35, 66; 399/159

See application file for complete search history.

(56) References Cited

U.S. PATENT DOCUMENTS

2014/0072907 A1* 3/2014 Sasaki et al. ..... 430/56

FOREIGN PATENT DOCUMENTS

JP 2010-134071 A 6/2010

* cited by examiner

*Primary Examiner* — Mark A Chapman

(74) *Attorney, Agent, or Firm* — Lucas & Mercanti, LLP

(57) ABSTRACT

An electrophotographic photoreceptor includes a conductive support and a photosensitive layer and a surface protection layer that are sequentially laminated on the conductive support. The surface protection layer contains a binder resin and inorganic fine particles surface-treated with a hole transporting compound of the following General Formula 1.

$A\text{-}(R_1\text{-}Q_1)_k$ [General Formula 1]

A is a hole transporting group. $Q_1$ is an acidic group. $R_1$ is a substituted or non-substituted alkylene, alkenylene or arylene group. k is a positive integer of 1 or more. If k is an integer of 2 or more, each of $R_1$ and $Q_1$ are same or different.

10 Claims, 2 Drawing Sheets

ELECTROPHOTOGRAPHIC PHOTORECEPTOR, ELECTROPHOTOGRAPHIC IMAGE FORMING APPARATUS AND PROCESS CARTRIDGE

BACKGROUND OF THE INVENTION

1. Field of the Invention

The present invention relates to an electrophotographic photoreceptor, an electrophotographic image forming apparatus and a process cartridge. To be more specific, the present invention relates to an electrophotographic photoreceptor that is durable and can form high-quality images, an electrophotographic image forming apparatus using the electrophotographic photoreceptor, and a process cartridge used for the electrophotographic image forming apparatus.

2. Description of Related Art

In recent years, there has been a need for smaller and maintenance-free electrophotographic image forming apparatuses as well as those with higher print output performance. Along with such needs, there has also been an increasing need for drum photoreceptors with smaller diameter (smaller size) and more durability, which are electrophotographic photoreceptors used in electrophotographic image forming apparatuses. Typical electrophotographic photoreceptors are organic photoreceptors (hereinafter also referred to as simply "photoreceptors"), and the photosensitive layer thereof, which is composed of a charge transfer material, a binder resin and the like, is prone to abrasion caused by mechanical load.

Photoreceptors deteriorate with repetitive image forming due to abrasion caused by friction with a cleaning blade. Moreover, the electric properties such as charging property and photosensitivity also deteriorate with repetitive charging and repetitive exposure. Such deterioration causes image defects such as low image density and smudgy background. Further, local flaws caused by abrasion of a photoreceptor surface cause image defects such as stripe due to imperfect cleaning, which results in decreased lifespan of photoreceptors.

To improve the durability of photoreceptors, it is required to improve the abrasion resistance of photoreceptors. For this reason, techniques of providing a surface protection layer on the surface of a photosensitive layer have been developed. One of techniques known in the art for providing a surface protection layer with high abrasion resistance is to add a curable binder resin and inorganic fine particles to a surface protection layer.

On the other hand, for preventing degradation of the electric properties of a surface layer, there is a technique known in the art of adding a charge transfer material so as to impart charge transfer capability to the surface protection layer.

However, conventional surface protection layers suffer from low compatibility between the low-molecular-weight charge transfer material and the curable binder resin. This causes inhibition of charge migration in the surface protection layers and raises a residual potential, which results in a problem of image defects such as low image density. Further, another problem with conventional surface protection layers is that the plasticization effect of the low-molecular weight charge transfer material decreases the abrasion resistance of the surface protection layers.

One of techniques known in the art for solving these problems is to add inorganic fine particles surface-treated with a hole transporting group-containing surface treatment agent to a surface protection layer (e.g. see JP 2010-134071A). This technique is to add inorganic fine particles surface-treated with a hole transporting group-containing alkoxysilane compound to a surface protection layer. By this feature, the inorganic fine particles are uniformly dispersed in the surface protection layer. As a result, the abrasion resistance is improved by the filler effect of the inorganic fine particles and a curable binder resin, and image blur in a hot and humid environment due to discharge products such as ozone and nitrogen oxides is prevented. Further, since charge (hole) migration is not inhibited in the surface protection layer due to the hole transporting group of the surface treatment agent, this technique is also advantageous in that the sensitivity properties are not impaired. However, a problem with this technique is an image memory effect in a hot and humid condition. As used herein, an image blur refers to a blur in toner images due to disordered electrostatic latent images, which are caused by hydrophilization of a photoreceptor surface by discharge products such as ozone and nitrogen oxides.

SUMMARY OF THE INVENTION

The present invention was made in consideration of the above-described problems and circumstances, and an object thereof is to provide an electrophotographic photoreceptor that has high abrasion resistance, does not cause an image blur in a hot and humid environment, and can form high-quality electrophotographic images with no image memory. Another object is to provide an electrophotographic image forming apparatus using the electrophotographic photoreceptor of the present invention, and to provide a process cartridge used for the electrophotographic image forming apparatus.

To accomplish the above-described objects, the present inventors searched for the causes of the above-described problems. During the study, they found that the above-described objects can be accomplished by a surface protection layer that includes a binder resin and inorganic fine particles surface-treated with an acidic group-containing hole transporting compound. The present invention was thus made.

To achieve at least one of the above-mentioned objects, according to a first aspect of the present invention, there is provided an electrophotographic photoreceptor including a conductive support and a photosensitive layer and a surface protection layer that are sequentially laminated on the conductive support, wherein the surface protection layer contains a binder resin and inorganic fine particles surface-treated with a hole transporting compound of the following General Formula 1, $$A\text{-}(R_1\text{-}Q_1)_k \qquad \text{[General Formula 1]}$$

where A is a hole transporting group; $Q_1$ is an acidic group; $R_1$ is a substituted or non-substituted alkylene, alkenylene or arylene group; k is a positive integer of 1 or more; and if k is an integer of 2 or more, each of $R_1$ and $Q_1$ are same or different.

Preferably, the hole transporting compound of General Formula 1 is a compound of the following General Formula 2,

[General Formula 2]

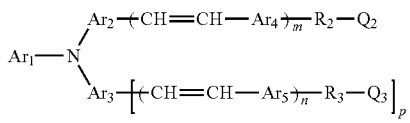

where $Ar_1$ is a substituted or non-substituted aryl group; $Ar_2$, $Ar_3$, $Ar_4$ and $Ar_5$, which are same or different, are each a substituted or non-substituted arylene group; $R_2$ and $R_3$, which are same or different, are each a substituted or non-substituted alkylene, alkenylene or arylene group; $Q_2$ and $Q_3$, which are same or different, are each an acidic group; m, n and p are each 0 or 1; and if p is 0, $Ar_3$ is a substituted or non-substituted aryl group.

Preferably, the acidic groups $Q_2$ and $Q_3$ of General Formula 2 are each a carboxyl group, a phosphonic acid group, a phosphinic acid group or a sulfonic acid group.

Preferably, the inorganic fine particles are metal oxide fine particles.

Preferably, the metal oxide fine particles are tin oxide fine particles, titanium oxide fine particles, zinc oxide fine particles or alumina fine particles.

Preferably, the binder resin contains a resin that is obtained by polymerizing a crosslinkable polymerizable compound.

Preferably, the crosslinkable polymerizable compound is a polymerizable compound having an acryloyl group or a methacryloyl group.

The mechanism of the advantageous effects and the functions of the present invention have not revealed yet, but the present inventors suggest them as follows.

Since the surface protection layer of the present invention contains the inorganic fine particles that are surface-treated with the hole transporting compound of the above General Formula 1 (hereinafter, also referred to as the "acidic group-containing hole transporting compound" or simply the "hole transporting compound"), the hole transporting compound is uniformly dispersed in the surface protection layer. As a result, inhibition of hole migration does not occur in the surface protection layer, and the electric properties such as charging property and sensitivity, which are generally required for electrophotographic photoreceptors, are not impaired. Furthermore, since the inorganic fine particles are dispersed in the surface protection layer, it is possible to form a robust coating due to the filler effect. This improves the abrasion resistance of the surface protection layer, which results in improved durability of the photoreceptor.

In contrast, surface treatment agents such as alkoxysilane compounds form a silanol group as a result of hydrolysis of their alkoxy group. After the silanol group migrates to the surface of inorganic fine particles by the action of a hydrogen bond to a hydroxyl group on the surface, dehydration condensation reaction is caused to form a robust covalent bond to the surface of the inorganic fine particles. At the same time, condensation reaction is caused between silanol groups to form a siloxane bond. A part of the alkoxysilane compound does not react with the inorganic fine particles, but reacts with itself to form a siloxane bond. That is, self-condensation is caused. Due to this self-condensation, the hole transporting compound that does not adsorb to the surface of the inorganic fine particles cannot exert sufficient hole transporting performance. As a result, the surface protection layer including such inorganic fine particles causes image memory (image density difference in accordance with a photoreceptor cycle).

It is known that an acidic group such as carboxyl group forms an ionic bond with a hydroxyl group on the surface of inorganic fine particles. Accordingly, the acidic group of the hole transporting compound of the present invention forms an ionic bond with a hydroxyl group on the surface of the inorganic fine particles. Since the inorganic fine particles to which the hole transporting compound is coupled through the ionic bond are uniformly dispersed in the surface protection layer, the surface protection layer does not lose the hole transporting performance while it can also form a robust coating. Therefore, it is possible to prevent an image blur due to discharge products such as ozone and nitrogen oxides. Further, since the hole transporting compound of the present invention does not have any self-condensable substituent unlike alkoxysilane compounds, self-condensation is not caused and impurities relating to self-condensation are not produced accordingly. It is assumed that an image memory is thus prevented.

BRIEF DESCRIPTION OF THE DRAWINGS

The present invention will become more fully understood from the detailed description given hereinbelow and the appended drawings which are given by way of illustration only, and thus are not intended as a definition of the limits of the present invention, and wherein.

DETAILED DESCRIPTION OF THE INVENTION

Figure 1:
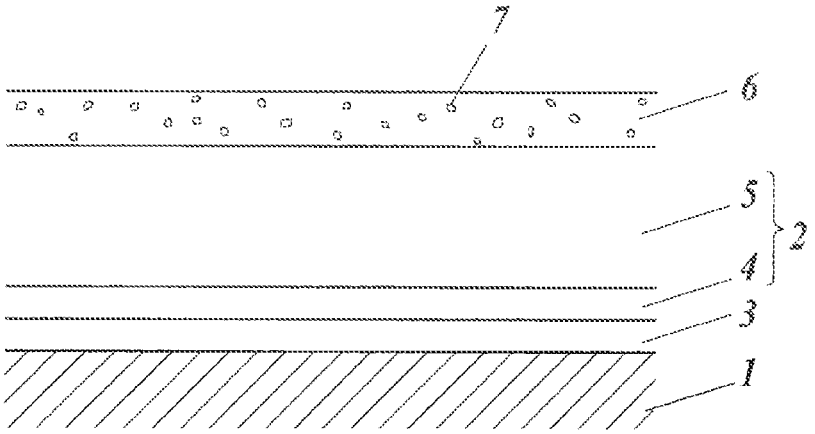
FIG. 1 is a schematic view illustrating an example of the layer structure of a photoreceptor.

Hereinafter, an embodiment of the present invention will be described with reference to the drawings. Though various technical limitations which are preferable to perform the present invention are included in the after-mentioned embodiment, the scope of the invention is not limited to the following embodiment and the illustrated examples.

The photoreceptor of the present invention is an electrophotographic photoreceptor, including a conductive support and a photosensitive layer and a surface protection layer that are sequentially laminated on the conductive support, wherein the surface protection layer contains a binder resin and inorganic fine particles that are surface-treated with the hole transporting compound of the above General Formula 1. This technical feature is common to the subject matter disclosed herein.

In terms of improving the advantageous effects of the present invention, the hole transporting compound of the above General Formula 1 is preferably a compound of the above General Formula 2 because it improves the hole transporting performance of the surface protection layer.

Further, the acidic groups $Q_2$ and $Q_3$ of the above General Formula 2 are each preferably a carboxyl group, a phosphonic acid group, a phosphinic group or a sulfonic group because such groups have high reactivity with a hydroxyl group on the surface of the inorganic fine particles.

Further, the inorganic fine particles are preferably metal oxide fine particles because a hydroxyl group present on the surface of metal oxide fine particles can form an ionic bond with the acidic group of the hole transporting material. Further, this feature is preferred also because metal oxide fine particles in the surface protection layer enhance the strength of the surface protection layer.

Further, the metal oxide fine particles are preferably tin oxide fine particles, titanium oxide fine particles, zinc oxide fine particles or alumina fine particles because such particles improve the abrasion resistance of the surface protection layer.

Further, it is preferred that the binder resin contains a resin that is obtained by polymerizing a crosslinkable polymerizable compound because such resins improve the abrasion resistance of the surface protection layer.

Further, the crosslinkable polymerizable compound is preferably a polymerizable compound having an acryloyl group or a methacryloyl group, because such compounds can easily polymerize by heat or light to form the surface protection layer having high abrasion resistance.

Further, the photoreceptor of the present invention is suitably used for the electrophotographic image forming apparatus that includes at least a charging unit which charges the electrophotographic photoreceptor, an exposing unit, a developing unit and a transfer unit, and for a process cartridge for the electrophotographic image forming apparatus.

Hereinafter, the components of the present invention and embodiments of the present invention will be described in detail. As used herein, the symbol "-" represents a range that includes the numerical values before and after the symbol as the lower and upper limits.

Electrophotographic Photoreceptor

The electrophotographic photoreceptor of the present invention is the electrophotographic photoreceptor including the photosensitive layer and the surface protection layer that are sequentially laminated on the conductive support, wherein the surface protection layer contains the binder resin and the inorganic fine particles that are surface-treated with the hole transporting compound of the following General Formula 1.

The photosensitive layer has both functions of generating charges by absorbing light and transporting the charges. The photosensitive layer may have a single-layered structure that is composed of a single layer containing a charge generating material and a charge transporting material, or a laminated structure that is composed of a charge generating layer containing a charge generating material and a charge transporting layer containing a charge transporting material. If necessary, an intermediate layer may be further provided between the conductive support and the photosensitive layer. The layer structure of the photosensitive layer is not particularly limited. Specifically, examples of layer structures, which are described including surface protection layer, include:

(1) a layer structure of the charge generating layer, the charge transporting layer and the surface protection layer, which are sequentially laminated on the conductive support;
(2) a layer structure of a single-layered photosensitive layer containing the charge transporting material and the charge generating material and the surface protection layer, which are sequentially laminated on the conductive support;
(3) a layer structure of the intermediate layer, the charge generating layer, the charge transporting layer and the surface protection layer, which are sequentially laminated on the conducive support; and
(4) a layer structure of the intermediate layer, the single-layered photosensitive layer containing the charge transporting material and the charge generating material and the surface protection layer, which are sequentially laminated on the conductive support.

The photoreceptor of the present invention may have any one of the above layer structures (1) to (4). Among them, preferred is the layer structure that is produced by sequentially laminating the intermediate layer, the charge generating layer, the charge transporting layer and the surface protection layer on the conductive support.

FIG. 1 is a schematic view illustrating an exemplary layer structure of the photoreceptor of the present invention. In FIG. 1, the reference signs indicate the following components: 1 conductive support, 2 photosensitive layer, 3 intermediate layer, 4 charge generating layer, 5 charge transporting layer, 6 surface protection layer, and 7 surface-treated inorganic fine particles.

Next, the configurations of the surface protection layer, conductive support, intermediate layer, and photosensitive layer (charge generating layer and charge transporting layer), which are the components of the photoreceptor of the present invention, will be described individually.

Surface Protection Layer

The surface protection layer of the present invention contains the binder resin and the inorganic fine particles surface-treated with the acidic group-containing hole transporting compound. These materials of the surface protection layer will be described individually.

Hole Transporting Compound

The surface protection layer of the present invention contains the binder resin and the inorganic fine particles that are surface-treated with the hole transporting compound of the following formula (1).

$$A\text{-}(\text{-}R_1\text{-}Q_1)_k$$ [General Formula 1]

In General Formula 1, A is a hole transporting group. $Q_1$ is an acidic group. $R_1$ is a substituted or non-substituted alkylene, alkenylene or arylene group. k is a positive integer of 1 or more, and if k is an integer of 2 or more, each of $R_1$s and $Q_1$s may be the same or different.

In the above General Formula 1, A is a hole transporting group, which may be any group having hole transporting capability. For example, such hole transporting groups include oxazole derivatives, oxadiazole derivatives, imidazole derivatives, triarylamine derivatives such as triphenylamine, styryltriphenylamine derivatives, distyryltriarylamine derivatives, trystyryltriarylamine derivatives, styrylanthracene derivatives, styrylpyrazoline derivatives, phenylhydrazone derivatives, triazole derivatives, thiaziazole derivatives, triazole derivatives, phenazine derivatives, acridine derivatives, benzofuran derivatives, benzimidazole derivatives, thiophene derivatives, N-phenylcarbazole derivatives and the like, which are described as hydrogen adducts (hole transporting compounds) where the binding site with $R_1$ of the General Formula 1 is substituted with a hydrogen. Among them, triarylamine derivatives, styryltriarylamine derivatives and distyryltriarylamine derivatives are preferred.

$R_1$ is an alkylene group, an alkenylene group or an arylene group. As an alkylene group, $R_1$ is an alkylene group of 1 to 4 carbon atoms, of which a methylene group is preferred. As an alkenylene group, $R_1$ is an alkenylene group of 2 to 4 carbon atoms, of which a vinylene group and a propenylene group are preferred. As an arylene group, $R_1$ is preferably a phenylene group or a naphthylene group. The substituent of a substituted alkylene or alkenlylene group is an alkyl group of 1 to 4 carbon atoms, a chlorine atom, a bromine atom, a cyano group, or a substituted or non-substituted amino group. The substituent of a substituted arylene groups is an alkyl group of 1 to 4 carbon atoms, a chlorine atom, a bromine atom, or a substituted or non-substituted amino group.

Further, the hole transporting compound of the above General Formula 1 is preferably a compound of the following General Formula 2.

[General Formula 2]

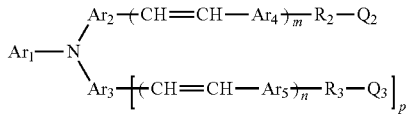

In the General Formula 2, $Ar_1$ is a substituted or non-substituted aryl group. Preferred aryl groups include a phenyl group and a naphthyl group. Such aryl group may have a substituent selected from alkyl groups of 1 to 4 carbon atoms, a chlorine atom, a bromine atom, and a substituted or non-substituted amino group.

$Ar_2$, $Ar_3$, $Ar_4$ and $Ar_5$, which may be the same or different, are each a substituted or non-substituted arylene group. Preferred arylene groups include a phenylene group and a naphthylene group. Such arylene groups may have a substituent selected from alkyl groups of 1 to 4 carbon atoms, a chlorine atom, a bromine atom, and a substituted or non-substituted amino group.

$R_2$ and $R_3$, which may be the same or different, are each defined as the same as $R_1$ of the General Formula 1. $Q_2$ and $Q_3$, which may be same or different, are each an acidic group. Each acidic group is a carboxyl group, a phosphonic group, a phosphine group or a sulfonic group. A carboxylic group is preferred. m, n and p are each 0 or 1. If p is 0, $Ar_3$ is a substituted or non-substituted aryl group. The substituent of a substituted aryl group is an alkyl group of 1 to 4 carbon atoms, a chlorine atom, a bromine atom, and a substituted or non-substituted amino group.

Specific compounds of the hole transporting compound of the above-described General Formula 1 include the following exemplary compounds.

[HTM-1]

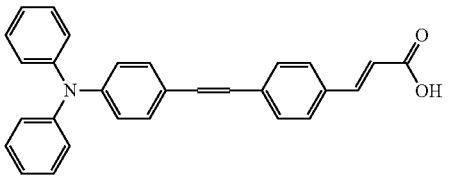

[HTM-2]

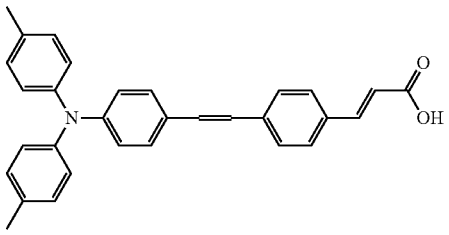

[HTM-3]

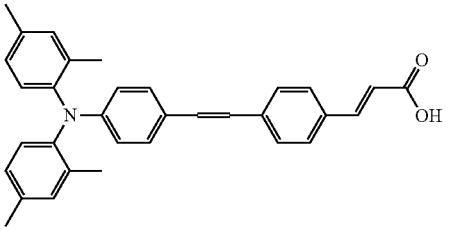

[HTM-4]

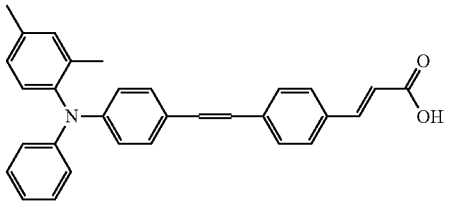

[HTM-5]

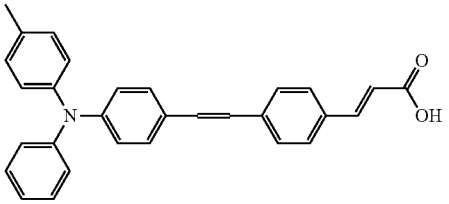

[HTM-6]

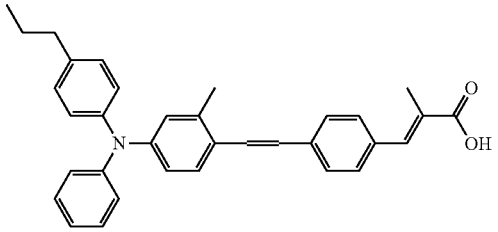

[HTM-7]

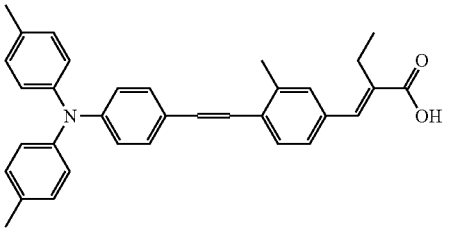

[HTM-8]

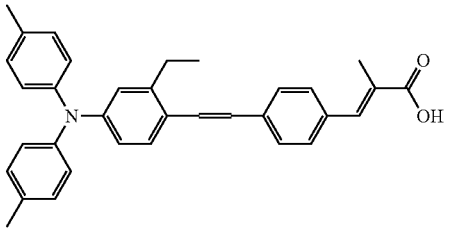

[HTM-9]

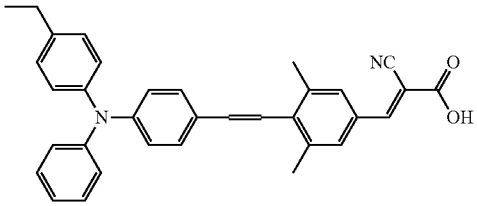

[HTM-10]

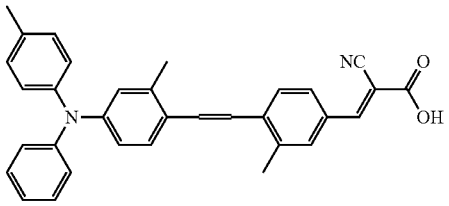

-continued
[HTM-11]
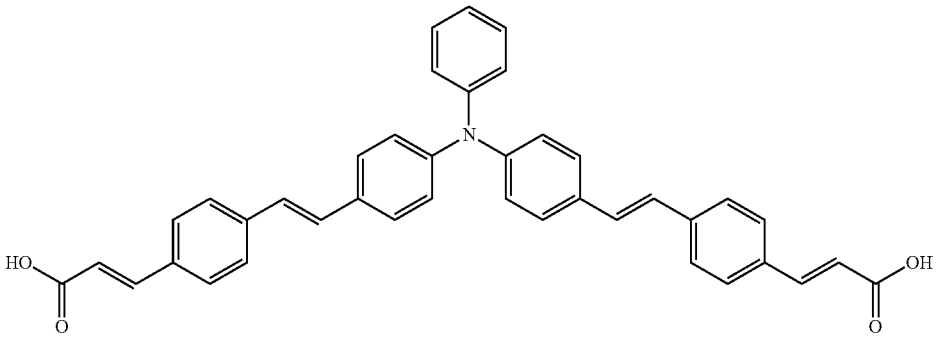
[HTM-12]
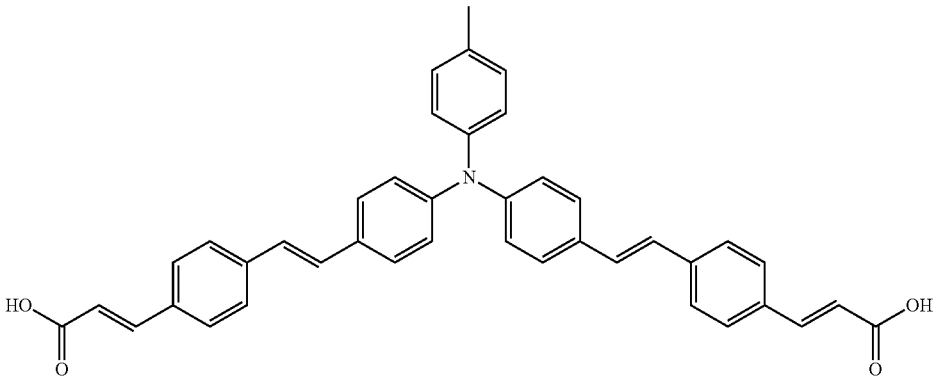
[HTM-13]
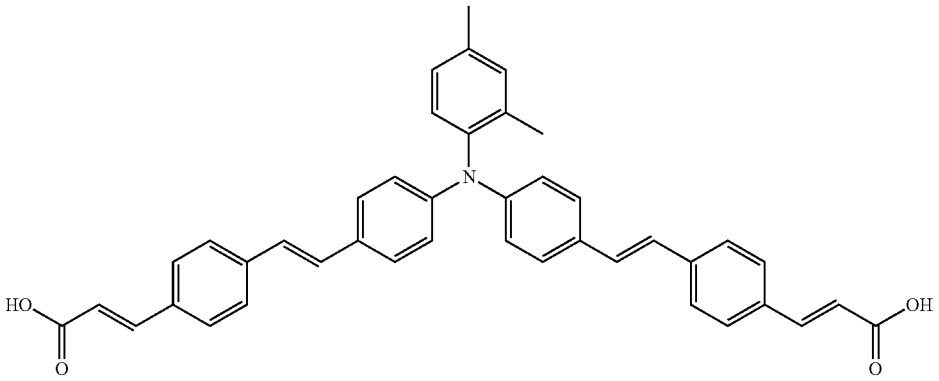
[HTM-14]
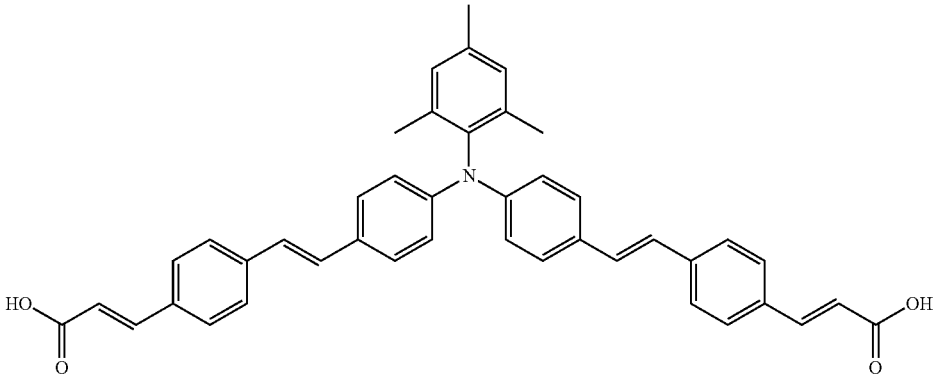

-continued
[HTM-15]
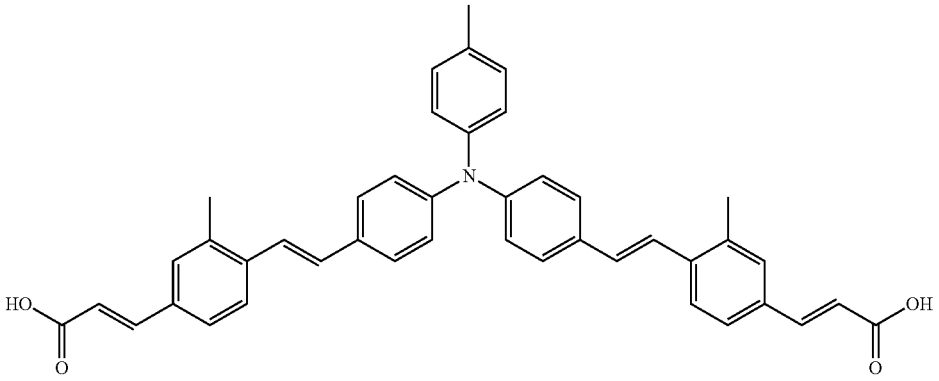
[HTM-16]
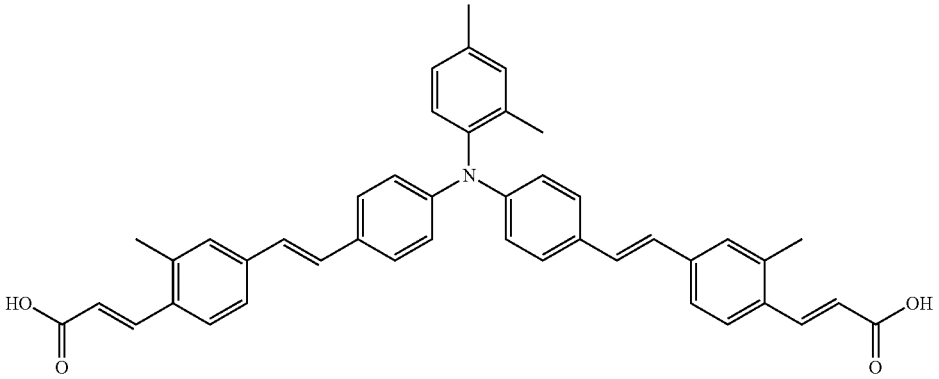
[HTM-17]
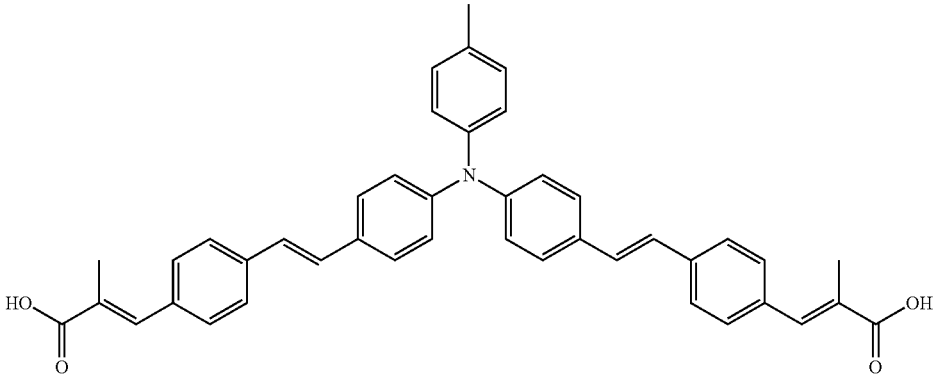
[HTM-18]
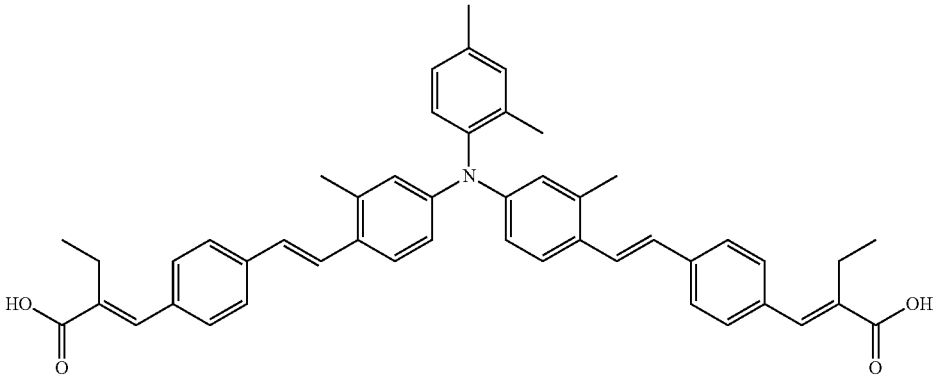

-continued
[HTM-19]
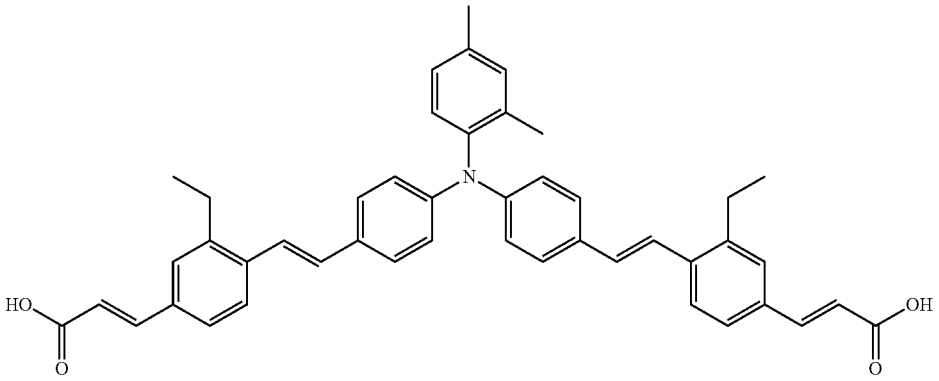
[HTM-20]
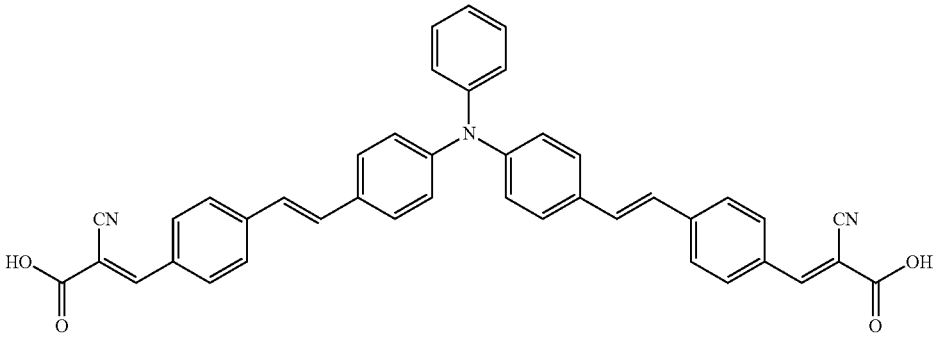
[HTM-21]
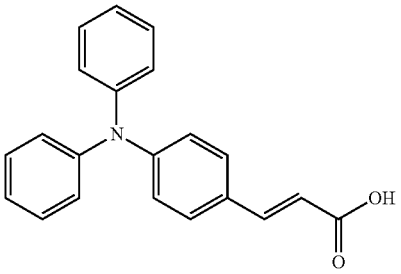
[HTM-22]
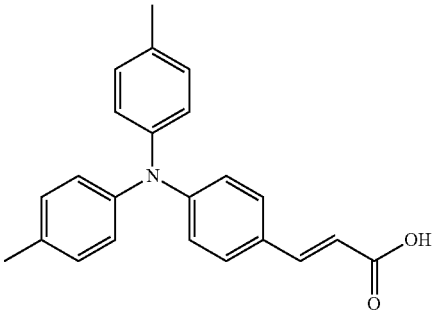
[HTM-23]
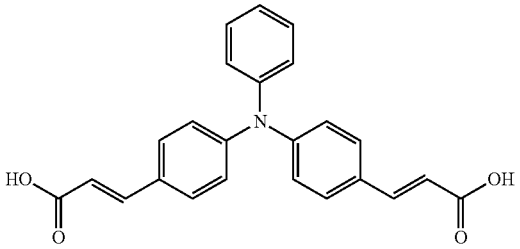
[HTM-24]
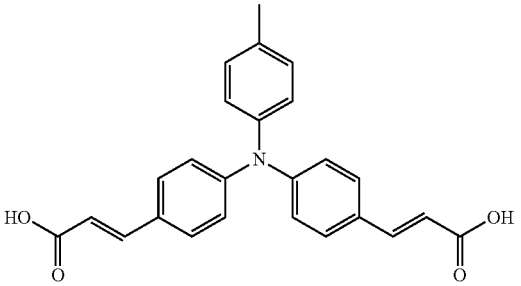

-continued
[HTM-25]
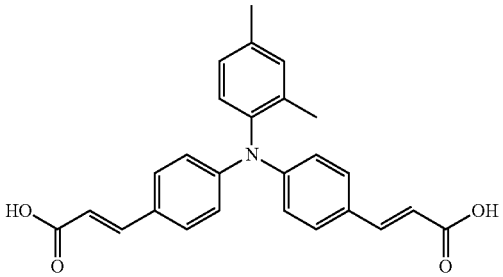
[HTM-26]
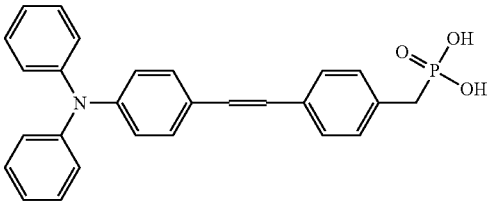
[HTM-27]
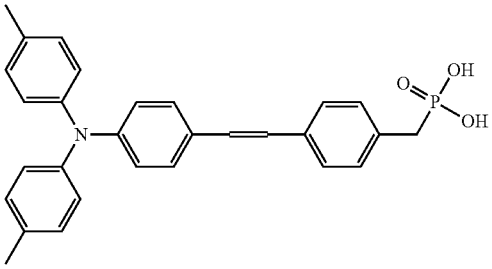
[HTM-28]
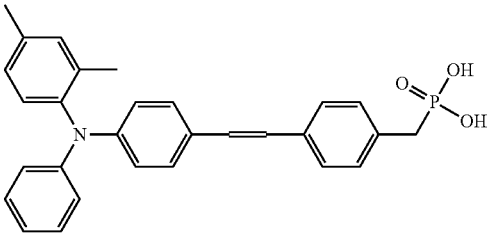
[HTM-29]
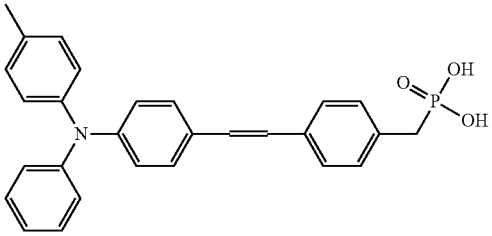
[HTM-30]
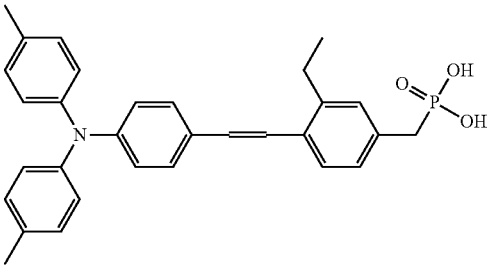
[HTM-31]
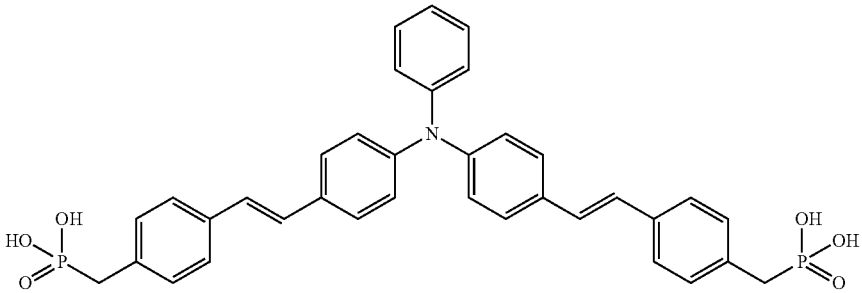
[HTM-32]
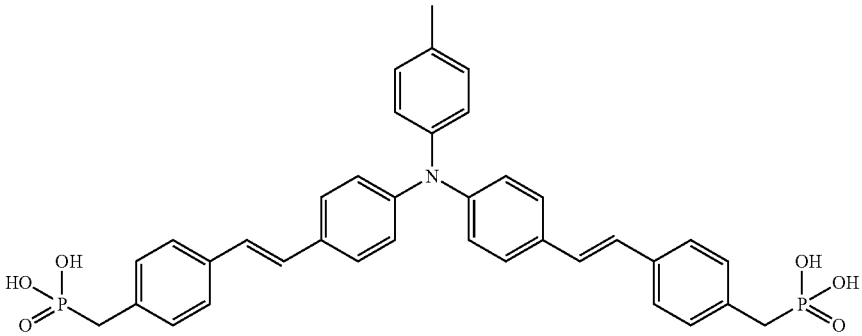

-continued
[HTM-33]
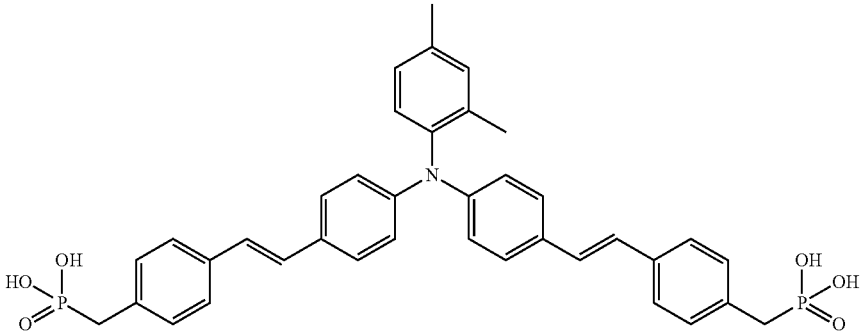
[HTM-34]
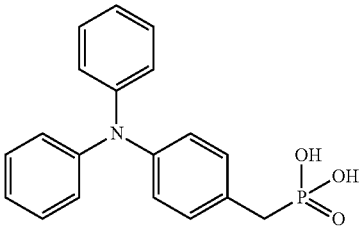
[HTM-35]
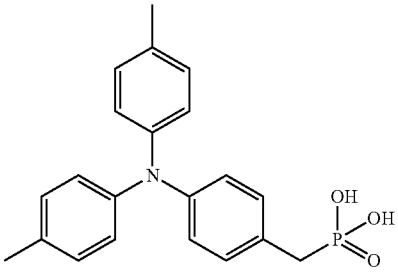
[HTM-36]
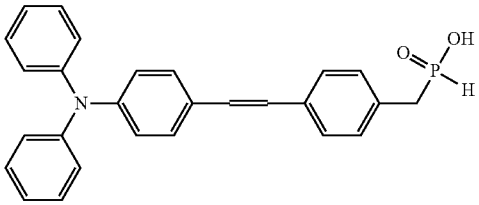
[HTM-37]
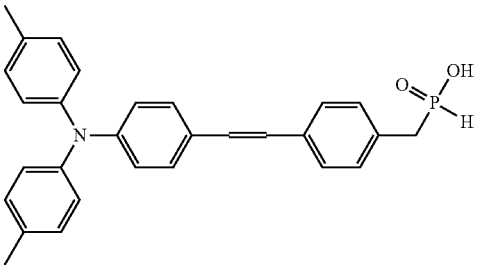
[HTM-38]
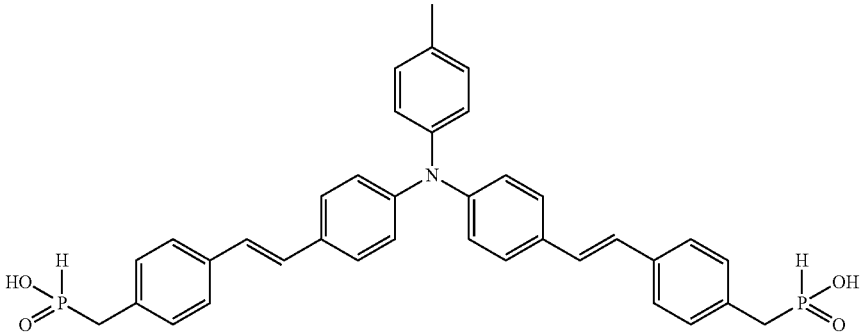
[HTM-39]
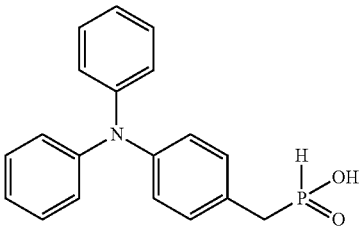
[HTM-40]
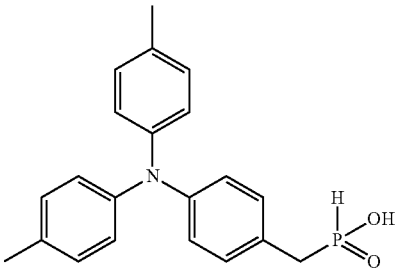

-continued
[HTM-41]
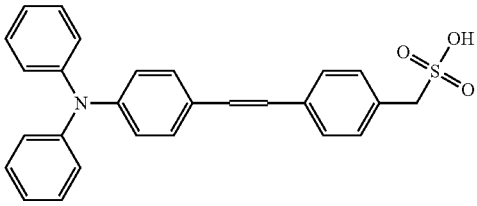
[HTM-42]
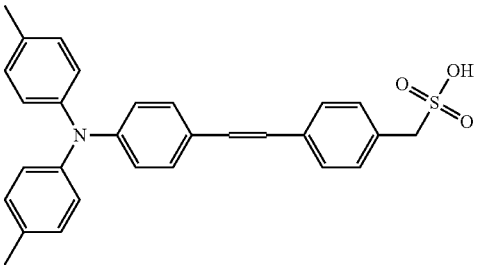
[HTM-43]
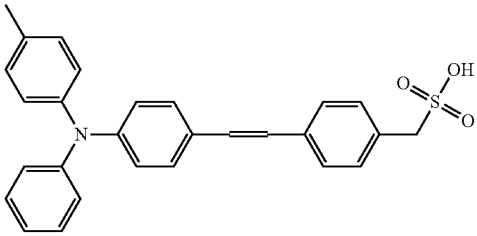
[HTM-44]
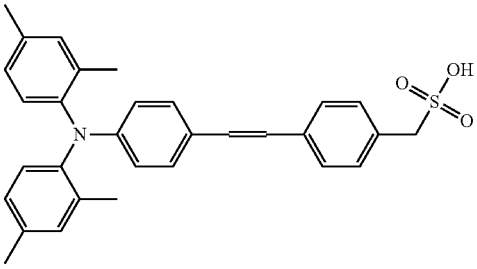
[HTM-45]
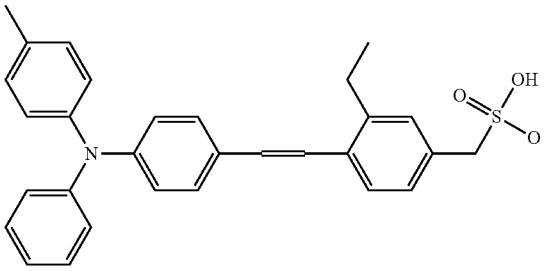
[HTM-46]
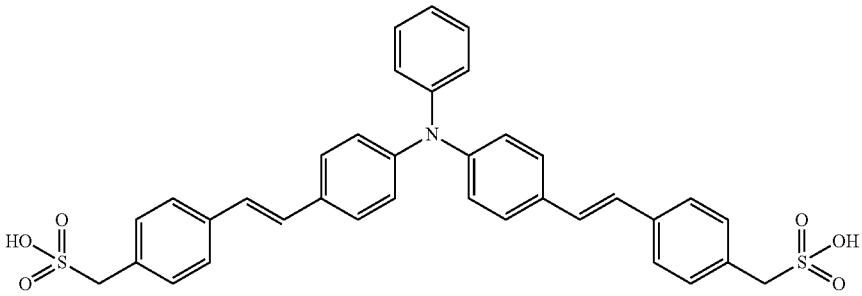
[HTM-47]
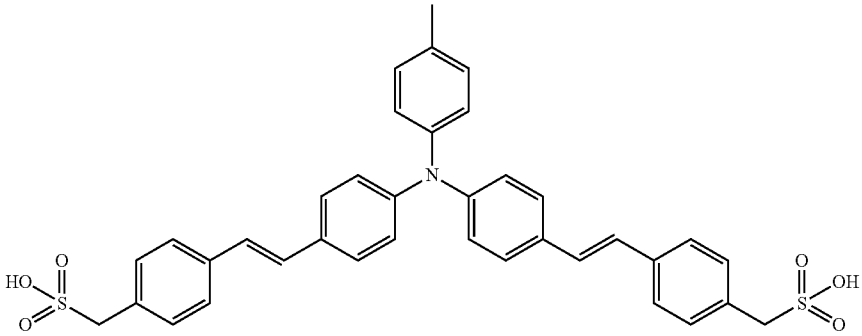

-continued

[HTM-48]

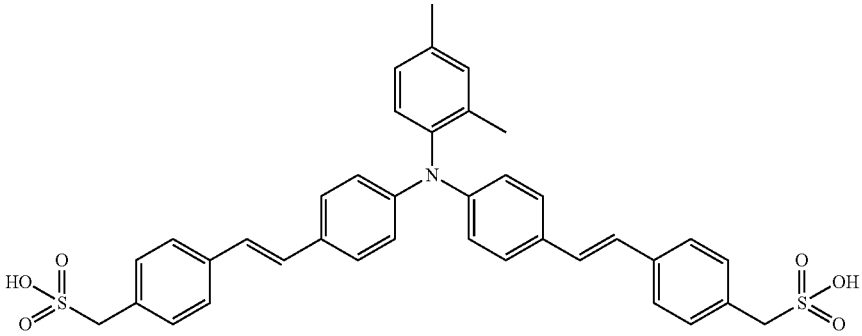

[HTM-49]

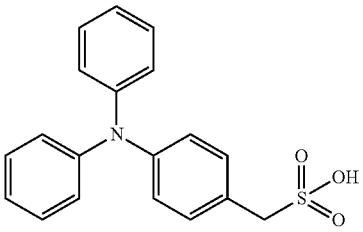

[HTM-50]

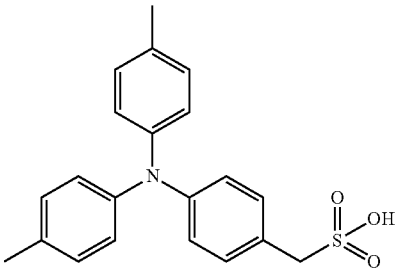

The hole transporting compound of the above General Formula 1 can be synthesized by synthetic methods known in the art. An exemplary synthetic method is described below.

SYNTHETIC METHOD

Synthesis Example 1

Synthetic Method of Exemplary Compound HTM-1

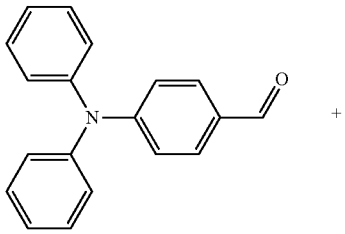

(1)

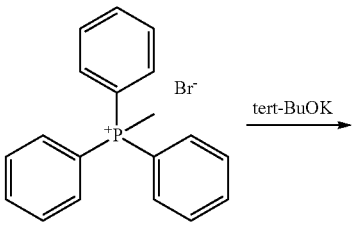

(2)

-continued

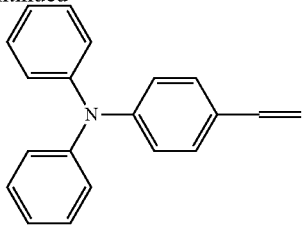

[3]

Into a 100 ml four-neck flask equipped with a nitrogen introducing tube, a thermometer, a cooling tube and a dropping funnel, 30.8 g (0.086 mol) of methyltriphenylphosphonium bromide (2), 11.9 g (0.106 mol) of potassium tert-butoxide and 15 ml of tetrahydrofuran (THF) were charged, and the mixture was stirred under nitrogen flow at room temperature for 1 hour.

Thereafter, 20 g (0.066 mol) of 4-(diphenylamino)benzaldehyde (1) dissolved in 40 ml of THF was charged into the dropping funnel, and was gradually added dropwise to the mixture. After the addition, a reaction was caused at room temperature for 2 hours. Then, 70 ml of water was added thereto. The product was extracted with ethyl acetate, and the extract was washed with water until neutralized. The organic phase was dried, concentrated and then purified by column chromatography. Pale yellow crystals of 4-(diphenylamino) styrene (3) (16 g, yield: 89%) was obtained.

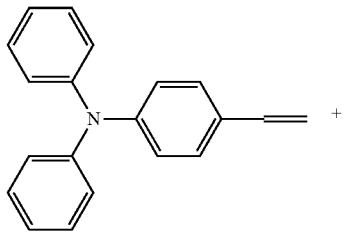

(3)

-continued

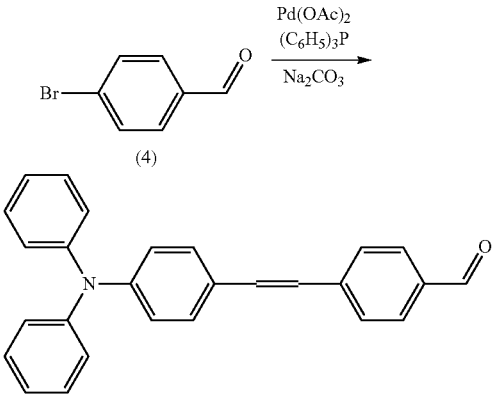

[5]

Into a 100 ml four-neck flask equipped with a nitrogen introducing tube, a thermometer, a cooling tube and a dropping funnel, a solution of 5 g (0.18 mol) of 4-(diphenylamino) styrene (3) in 25 ml of N,N-dimethylacetoamide (DMA) was charged. To the solution, 3.7 g (0.02 mol) of 4-bromobenzaldehyde (4), 0.17 g (0.74 mmol) of palladium acetate, 0.77 g (2.95 mmol) of triphenylphosphine, 3.12 g (0.29 mol) of sodium carbonate were added, and a reaction was caused under nitrogen flow at 110° C. for 12 hours.

After cooled to room temperature, 70 ml of water was added. The product was extracted with ethyl acetate, and the extract was washed with water until neutralized. The organic phase was dried, concentrated and then purified by column chromatography. Yellow crystals of Compound (5) (5.9 g, yield: 89%) was obtained.

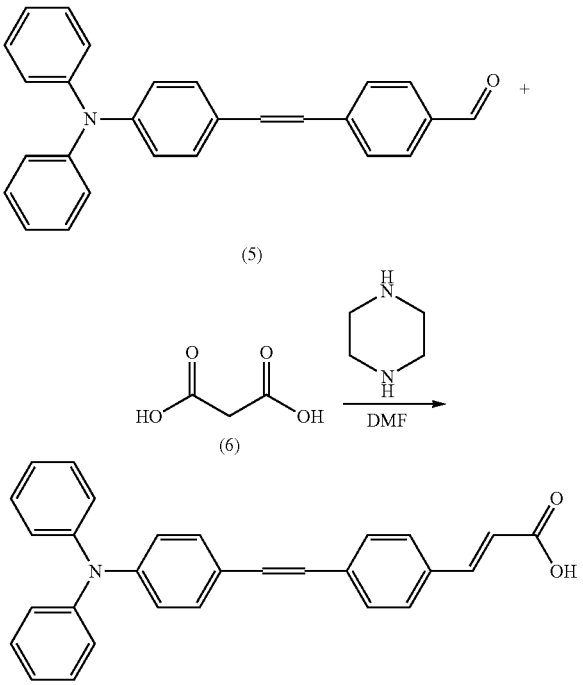

[HTM-1]

Into a 100 ml four-neck flask equipped with a nitrogen introducing tube, a thermometer, a cooling tube and a dropping funnel, 5 g (0.013 mol) of Compound (5), 1.7 g (0.016 mol) of malonic acid (6), 0.57 g (0.007 mol) of piperazine and 33 ml of dimethylformamide (DMF) are charged, and a reaction was caused under nitrogen flow at 125° C. for 6 hours. After the reaction solution was cooled to 100° C. or less, 10% aqueous solution of sulfuric acid was added dropwise over 30 min, and then the solution was stirred for 30 min. The solution was extracted with ethyl acetate, and the extract was washed with water until neutralized. The organic phase was dried and concentrated, and then purified by column chromatography to yield yellow crystals of HTM-1 (5.5 g, 98%).

The resulting compound was identified as HTM-1 by nuclear magnetic resonance method ($^1$H-NMR).

$^1$H-NMR (300 MHz, DMSO) δ ppm: 6.27 (d, 2H), 7.00-7.45 (m, 19H), 7.89 (d, 2H), 12.05 (d, 1H)

Synthesis Example 2

Synthetic Method of Exemplary Compound HTM-26

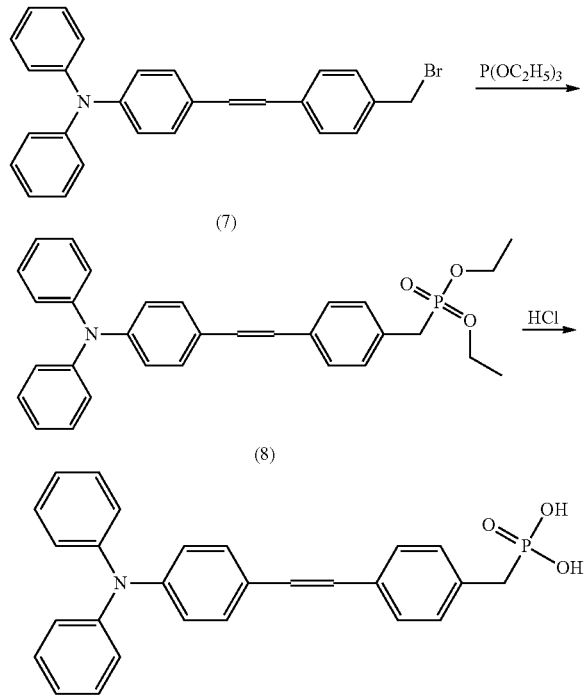

[HTM-26]

Into a 100 ml four-neck flask equipped with a thermometer, a cooling tube and a dropping funnel, 5 g (0.011 mol) of Compound (7) is charged. To the flask, 9.0 g (0.055 mol) of triethyl phosphite was gradually added dropwise. The temperature was gradually raised, and the solution was refluxed for 6 hours. After the reaction, residual triethyl phosphite was evaporated, and the resulting product was purified by column chromatography to yield Compound (8) (4.7 g, 83%). The obtained Compound (8) was refluxed together with 10 ml of conc. hydrochloric acid for 24 hours to yield 3.6 g (86%) of HTM-26.

The resulting compound was identified as HTM-39 by nuclear magnetic resonance method ($^1$H-NMR).

$^1$H-NMR (300 MHz, DMSO) δ ppm: 2.94 (d, 2H), 4.80 (s, 2H), 7.00-7.24 (m, 16H), 7.71 (d, 2H), 7.89 (d, 2H)

Synthesis Example 3

Synthetic Method of Exemplary Compound HTM-41

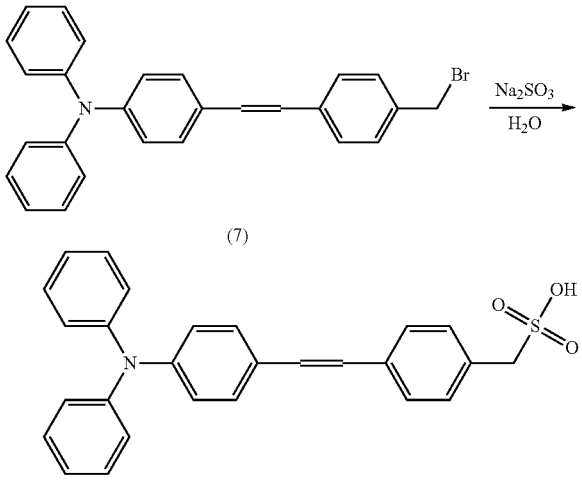

[HTM-41]

Into a 50 ml four-neck flask equipped with a thermometer and a cooling tube, 5 g (0.011 mol) of Compound (7), 1.9 g (0.015 mol) of sodium sulfite and 15 ml of water were charged, and the mixture was refluxed for 12 hours. After the reaction, the resulting product was purified by column chromatography to yield 3.9 g (81%) of HTM-41.

The resulting compound was identified as HTM-42 by nuclear magnetic resonance method (1H-NMR).

$^1$H-NMR (300 MHz, DMSO) δ ppm: 4.29 (s, 1H), 7.00-7.24 (m, 16H), 7.71 (d, 2H), 7.89 (d, 2H), 8.5 (s, 1H)

Inorganic Fine Particles Surface-Treated with Hole Transporting Compound

Next, the inorganic fine particles surface-treated with the hole transporting compound will be described.

The inorganic fine particles of the present invention are surface-treated with the hole transporting compound of the above General Formula 1 (hereinafter, also referred to as simply the "surface-treated inorganic fine particles").

Inorganic Fine Particles

The inorganic fine particles of the present invention are preferably metal (including transit metals) oxide fine particles. Examples of such fine particles include metal oxide fine particles of silica (silicon dioxide), magnesium oxide, zinc oxide, lead oxide, aluminum oxide, tantalum oxide, indium oxide, bismuth oxide, yttrium oxide, cobalt oxide, copper oxide, manganese oxide, selenium oxide, iron oxide, zirconium oxide, germanium oxide, tin oxide, titanium oxide, niobium oxide, molybdenum oxide and vanadium oxide, of which tin oxide fine particles, titanium oxide fine particles, zinc oxide fine particles and alumina fine particles are preferred.

It is preferred that the above-described metal oxide fine particles are manufactured by ordinary methods known in the art such as vapor phase method, chlorine method, sulfuric acid method, plasma method and electrolysis method.

It is preferred that the organic fine particles have a number average primary particle size of 1-300 nm. A particle size of 3-100 nm is particularly preferred.

Method of Measuring Particle Size of Inorganic Fine Particles

The number average primary particle size of the inorganic particles are measured by photographing the particles at 10000-fold magnification under a scanning electron microscope (JEOL, Ltd.), scanning randomly-selected 300 particles (excluding aggregated particles) by a scanner, binarizing the scanned photographic images and calculating the horizontal Feret diameter of each particle by using an automatic image processing device (LUZEX (registered trademark) AP, Nireco Corporation) with a software ver. 1.32, and calculating the average thereof. As used herein, a horizontal Feret diameter refers to the length of the sides parallel to the x axis of a quadrangle that is circumscribed with a binarized image of an inorganic fine particle.

Surface Treatment Method of Inorganic Fine Particles

For the surface treatment of the inorganic fine particles, it is preferred that the inorganic fine particles are subject to a dispersion treatment using a wet- and medium-type dispersing machine where 0.1-100 parts by mass of the acidic group-containing hole transporting compound is added to 100 parts by mass of the inorganic fine particles. Within the range, the electric properties are not impaired by the surface protection layer, while the image memory is improved. Further, it is preferred to use 50-5000 parts by mass of solvent with respect to 100 parts by mass of the inorganic fine particles.

The solvent to be used for the surface treatment may be any solvent that disperses the inorganic fine particles well and dissolves the acidic group-containing hole transporting compound. Examples of such solvents include toluene, xylene, methylene chloride, methylethylketone, cyclohexane, acetone, ethyl acetate, butyl acetate, tetrahydrofuran, 1,4-dioxane, 1,3-dioxolane and the like.

A wet- and medium-type dispersing machine, which is the surface treatment machine used in the present invention, grinds and disperses aggregated inorganic particles by charging beads in a container as a medium and rapidly spinning agitation disks orthogonally coupled to a rotation axis. Such dispersing machines may be of any type that can sufficiently disperse the inorganic fine particles during the surface treatment, and can perform the surface treatment, such as either vertical/horizontal type and either continuous/batch type.

Specifically, a sand mill, an Ultravisco mill, a pearl mill, a grain mill, a Dyno mill, an agitator mill, a dynamic mill, or the like can be used. These dispersing machines use a grinding medium such as balls and beads to perform fine grinding and dispersion by the action of impact crush, friction, shear, shear stress and the like.

The beads of a sand grinder mill may be balls made of glass, alumina, zircon, zirconia, steel, flint stone and the like. Zirconia or zircon balls are particularly preferred. A typical size of the beads is approximately 1-2 mm in diameter. However, in the present invention, a preferred size is approximately 0.1-1.0 mm.

The disks and the inner wall of the container of such wet- and medium-type dispersing machines may be made of various materials such as stainless, nylon and ceramics. In the present invention, it is particularly preferred that the disks and the container inner wall are made of ceramics such as zirconia and silicon carbide.

The following is a further detailed description of the surface treatment method for producing the inorganic fine particles whose surface is uniformly and more finely coated with the acidic group-containing hole transporting compound.

Specifically, a slurry (suspension of solid particles) containing the inorganic fine particles and the acidic group-containing hole transporting compound is subject to wet grinding so that the pulverization and the surface treatment of the inorganic fine particles are performed at the same time. The wet grinding of the slurry may be performed at a temperature of 40° C.-80° C.

Since the acidic group-containing hole transporting compound does not react with itself even if it is heated while the treatment, it can be heated for promoting the reaction with the inorganic fine particles.

After the treatment, the solvent is removed, and the product is treated with heat and pulverized. In this way, it is possible to obtain the inorganic fine particles that are uniformly and more finely surface-treated with the acidic group-containing hole transporting compound. By this treatment, it is assumed that the acidic group of the hole transporting compound, such as carboxylic group, forms an ionic bond with a hydroxyl group present on the surface of the inorganic fine particles.

Binder Resin

The binder resin of the surface protection layer may be a hard polymer such as polycarbonate and polyacrylate, preferably a resin that is produced by curing a crosslinkable polymerizable compound.

Suitable crosslinkable polymerizable compounds are monomers that polymerize (cure) by irradiation with an active ray such as ultraviolet ray or electron beam to form a resin generally used as a binder resin of photoreceptors, such as polystyrene and polyacrylate. In particular, styrene monomers, acrylate monomers, metacrylate monomers, vinyltoluene monomers, vinyl acetate monomers and N-vinylpyrrolidone monomers are preferred. Among them, radically polymerizable monomers having an acryloyl group ($CH_2{=}CHCO{-}$) or a methacryloyl group ($CH_2{=}CCH_3CO{-}$) are particularly preferred because of the curability by weak or short exposure to light.

In the present invention, these crosslinkable polymerizable compounds may be used either alone or in combination of two or more.

The followings are exemplary crosslinkable polymerizable compounds. The number of Ac group(s) and the number of Mc group(s) refer to the number of acryloyl group(s) and the number of methacryloyl group(s) in a molecule respectively.

| Exemplary Compound No. | Structural Formula | Number of Ac Group (s) |
|---|---|---|
| Ac-1 | 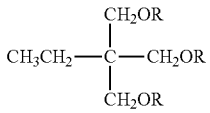 | 3 |
| Ac-2 | 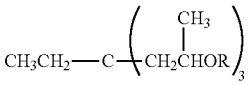 | 3 |
| Ac-3 | 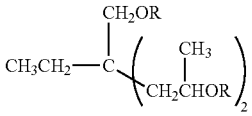 | 3 |
| Ac-4 | 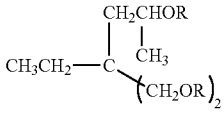 | 3 |
| Ac-5 | 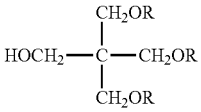 | 3 |
| Ac-6 | 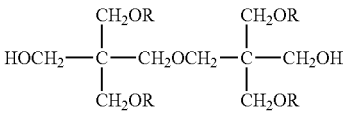 | 4 |
| Ac-7 | 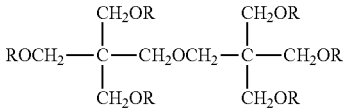 | 6 |
| Ac-8 | 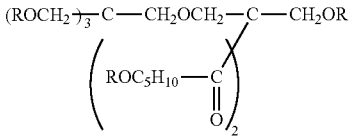 | 6 |

-continued
| Exemplary Compound No. | Structural Formula | Number of Ac Group (s) |
|---|---|---|
| Ac-9 | 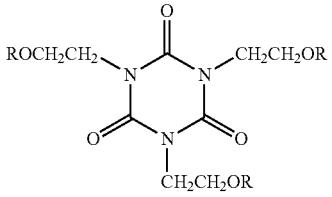 | 3 |
| Ac-10 | $CH_3CH_2C-(CH_2OC_3H_6OR)_3$ | 3 |
| Ac-11 | 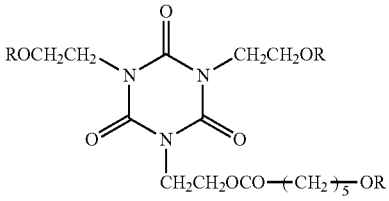 | 3 |
| Ac-12 | $(ROCH_2)_3C-O-C-(CH_2OR)_3$ | 6 |
| Ac-13 | $(ROCH_2)_3C-CH_2OCH_2-C(H)-(CH_2OR)_2$ | 5 |
| Ac-14 | $(ROCH_2)_3C-CH_2OCH_2-C(CH_3)-(CH_2OR)_2$ | 5 |
| Ac-15 | $(ROCH_2)_3C-CH_2OCH_2-C(CH_2OH)-(CH_2OR)_2$ | 5 |
| Ac-16 | $(ROCH_2)_3C-CH_2OCH_2-C(CH_2OR)-(CH_2OH)_2$ | 4 |
| Ac-17 | $(ROCH_2)_3C-O-C(CH_2OH)-(CH_2OR)_2$ | 5 |
| Ac-18 | 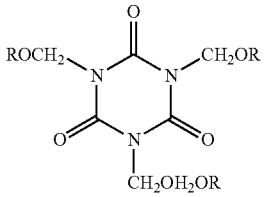 | 3 |
| Ac-19 | $CH_3CH_2C-(CH_2CH_2OR)_3$ | 3 |
| Ac-20 | $HOCH_2-C\left(CH_2O-C(=O)CH_2CH_2CH_2CH_2CH_2OR\right)_3$ | 3 |
| Ac-21 | 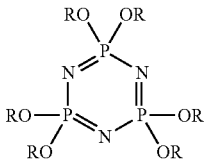 | 6 |

-continued
| Exemplary Compound No. | Structural Formula | Number of Ac Group (s) |
|---|---|---|
| Ac-22 | 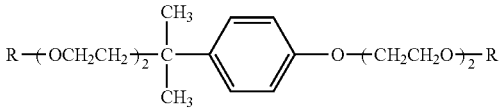 | 2 |
| Ac-23 | 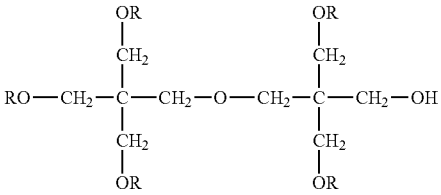 | 5 |
| Ac-24 | 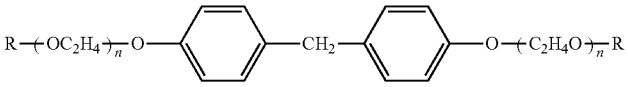 (n ≈ 2) | 2 |
| Ac-25 | 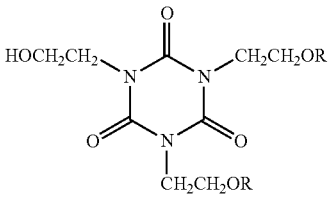 | 2 |
| Ac-26 | $R-(OC_3H_6)_3-OR$ | 2 |
| Ac-27 | 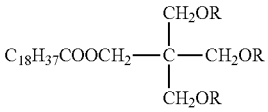 | 2 |
| Ac-28 | 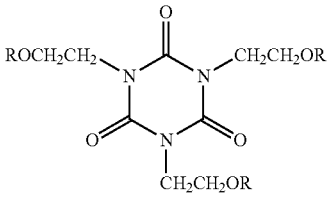 | 3 |
| Ac-29 | $[R-(OC_3H_6)_n-OCH_2)_3CCH_2CH_3$ (n ≈ 3) | 3 |
| Ac-30 | 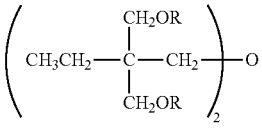 | 4 |
| Ac-31 | $(ROCH_2)_4C$ | 4 |
| Ac-32 | $RO—C_6H_{12}—OR$ | 2 |
| Ac-33 | 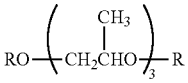 | 2 |

-continued

| Exemplary Compound No. | Structural Formula | Number of Ac Group (s) |
|---|---|---|
| Ac-34 | $RO-(C_2H_4O)_2$ 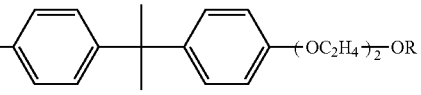 $(OC_2H_4)_2-OR$ | 2 |
| Ac-35 | $ROCH_2-$ 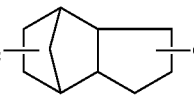 $-CH_2OR$ | 2 |
| Ac-36 | $RO-(C_2H_4O)_9-R$ | 2 |
| Ac-37 | $CH_3CH_2-C(CH_2-(OC_2H_4)_l-OR)(CH_2-(OC_2H_4)_m-OR)(CH_2-(OC_2H_4)_n-OR)$ (l + m + n = 3) | 3 |
| Ac-38 | $CH_3CH_2-C(CH_2-(OCOC_6H_{12})_l-OR)(CH_2-(OCOC_6H_{12})_m-OR)(CH_2-(OCOC_6H_{12})_n-OR)$ (l + m + n = 3) | 3 |
| Ac-39 | $RO(CH_2)_2OCONHCH_2-C(CH_3)_2-CH_2CH(CH_2)_2NHCOO(CH_2)_2OR$ ($CH_3$) | 2 |
| | $RO(CH_2)_2OCONHCH_2CH(CH_3)CH_2-C(CH_3)_2-(CH_2)_2NHCOO(CH_2)_2OR$ Mixture of Above | 2 |
| Ac-40 | $(ROCH_2)_3CCH_2OCONH(CH_2)_6NHCOOCH_2C(CH_2OR)_3$ | 6 |
| Ac-41 | $C_2H_5-C(OR)_2-CH_2OCH_2-C(OR)_2-C_2H_5$ | 4 |

In the above formula, R represents the following structure.

R = $-C(=O)-CH(H)=CH_2$

| Exemplary Compound No. | Structural Formula | Number of Mc Group (s) |
|---|---|---|
| Mc-1 | $CH_3CH_2-C(CH_2OR')_3$ | 3 |

-continued
| Exemplary Compound No. | Structural Formula | Number of Mc Group (s) |
|---|---|---|
| Mc-2 | $CH_3CH_2-C(CH_2CH(CH_3)OR')_3$ | 3 |
| Mc-3 | $CH_3CH_2-C(CH_2OR')(CH_2CH(CH_3)OR')_2$ | 3 |
| Mc-4 | $CH_3CH_2-C(CH_2CHOR')(CH_3)(CH_2OR')_2$ | 3 |
| Mc-5 | $HOCH_2-C(CH_2OR')_3$ | 3 |
| Mc-6 | $HOCH_2-C(CH_2OR')_2-CH_2OCH_2-C(CH_2OR')_2-CH_2OH$ | 4 |
| Mc-7 | $R'OCH_2-C(CH_2OR')_2-CH_2OCH_2-C(CH_2OR')_2-CH_2OR'$ | 6 |
| Mc-8 | $(R'OCH_2)_3C-CH_2OCH_2-C(CH_2OR')(R'OC_5H_{10}-C(=O))_2$ | 6 |
| Mc-9 | 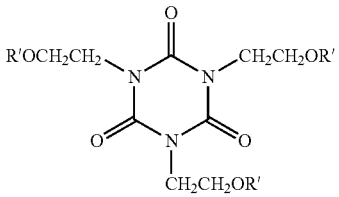 | 3 |
| Mc-10 | $CH_3CH_2C(CH_2OC_3H_6OR')_3$ | 3 |
| Mc-11 | 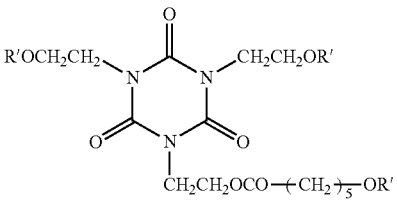 | 3 |
| Mc-12 | $(R'OCH_2)_3C-O-C(CH_2OR')_3$ | 6 |
| Mc-13 | $(R'OCH_2)_3C-CH_2OCH_2-C(H)(CH_2OR')_2$ | 5 |

-continued
| Exemplary Compound No. | Structural Formula | Number of Mc Group (s) |
|---|---|---|
| Mc-14 | $(R'OCH_2)_3C—CH_2OCH_2—C(CH_3)(CH_2OR')_2$ | 5 |
| Mc-15 | $(R'OCH_2)_3C—CH_2OCH_2—C(CH_2OH)(CH_2OR')_2$ | 5 |
| Mc-16 | $(R'OCH_2)_3C—CH_2OCH_2—C(CH_2OR')(CH_2OH)_2$ | 4 |
| Mc-17 | $(R'OCH_2)_3C—O—C(CH_2OH)(CH_2OR')_2$ | 5 |
| Mc-18 | 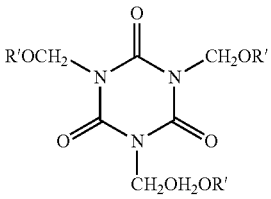 | 3 |
| Mc-19 | $CH_3CH_2C(CH_2CH_2OR')_3$ | 3 |
| Mc-20 | $HOCH_2—C(CH_2O—C(=O)CH_2CH_2CH_2CH_2CH_2OR')_3$ | 3 |
| Mc-21 | 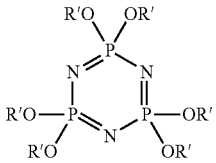 | 6 |
| Mc-22 | 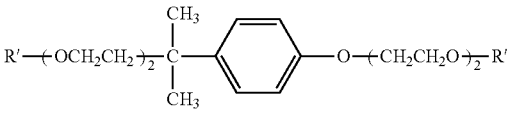 | 2 |
| Mc-23 | 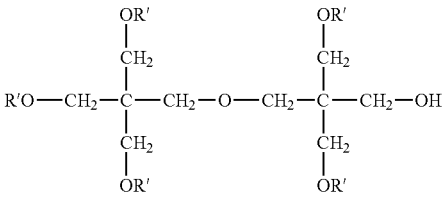 | 5 |
| Mc-24 | 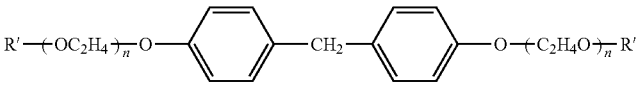 (n ≈ 2) | 2 |
| Mc-25 | 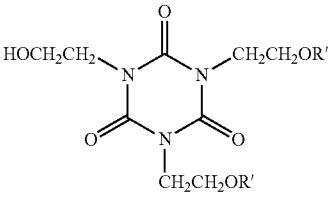 | 2 |

-continued

| Exemplary Compound No. | Structural Formula | Number of Mc Group (s) |
|---|---|---|
| Mc-26 | $R'-(OC_3H_6)_3-OR'$ | 2 |
| Mc-27 | $C_{18}H_{37}COOCH_2-C(CH_2OR')_2-CH_2OH$ | 2 |
| Mc-28 | 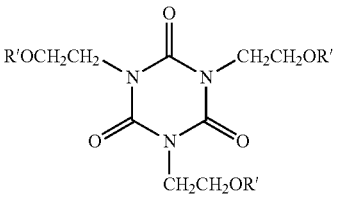 | 3 |
| Mc-29 | $[R'-(OC_3H_6)_n-OCH_2]_3CCH_2CH_3$ (n ≈ 3) | 3 |
| Mc-30 | $(CH_3CH_2-C(CH_2OR')_2-CH_2-O)_2$ | 4 |
| Mc-31 | $(R'OCH_2)_4C$ | 4 |
| Mc-32 | $R'O-C_6H_{12}-OR'$ | 2 |
| Mc-33 | $R'O-(CH_2CH(CH_3)O)_3-R'$ | 2 |
| Mc-34 | 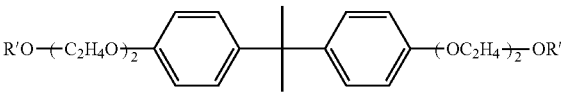 | 2 |
| Mc-35 | 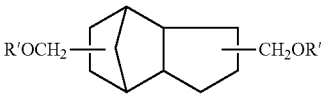 | 2 |
| Mc-36 | $R'O-(C_2H_4O)_9-R'$ | 2 |
| Mc-37 | $CH_3CH_2-C(CH_2-(OC_2H_4)_l-OR')(CH_2-(OC_2H_4)_m-OR')(CH_2-(OC_2H_4)_n-OR')$ (l + m + n = 3) | 3 |
| Mc-38 | $CH_3CH_2-C(CH_2-(OCOC_6H_{12})_l-OR')(CH_2-(OCOC_6H_{12})_m-OR')(CH_2-(OCOC_6H_{12})_n-OR')$ (l + m + n = 3) | 3 |
| Mc-39 | $R'O(CH_2)_2OCONHCH_2-C(CH_3)_2-CH_2CH(CH_2)_2NHCOO(CH_2)_2OR'$ | 2 |

-continued

| Exemplary Compound No. | Structural Formula | Number of Mc Group (s) |
|---|---|---|
| | $R'O(CH_2)_2OCONHCH_2CH(CH_3)CH_2-C(CH_3)_2-(CH_2)_2NHCOO(CH_2)_2OR'$ | 2 |
| | Mixture of Above | |
| Mc-40 | $(R'OCH_2)_3CCH_2OCONH(CH_2)_6NHCOOCH_2C(CH_2OR')_3$ | 6 |
| Mc-41 | $C_2H_5-C(OR')_2-CH_2OCH_2-C(OR')_2-C_2H_5$ | 4 |

In the above formula, R' represents the following structure.

$$R' = -C(=O)-C(CH_3)=CH_2$$

In the present invention, it is preferred that the crosslinkable polymerizable compound has three or more functional groups (reactive groups). Further, two or more polymerizable compounds may be used in combination. In this case, it is preferred that the polymerizable compounds are composed of at least 50 mass % of a compound having three or more functional groups.

Further, it is preferred that the inorganic fine particles surface-treated with the acidic group-containing hole transporting compound is used in the amount of 50-200 parts by mass, more preferably 100-150 parts by mass with respect to 100 parts by mass of the binder resin or the crosslinkable polymerizable compound. Within the range, it is possible to obtain the robust surface protection layer that has high abrasion resistance. Further, since the layer has sufficient hole transporting capability, the electrophotographic properties are not impaired.

Other Additives

The surface protection layer of the present invention may contain various types of charge transporting materials and antioxidants. Furthermore, various types of lubricant particles may be added. For example, fluorine atom-containing resin particles may be added as lubricant particles. It is preferred that fluorine atom-containing resin particles are made of one or more material selected from ethylene tetrafluoride resin, chloroethylene trifluoride resin, chloroethylene-propylene hexafluoride resin, vinyl fluoride resin, vinylidene fluoride resin, dichloroethylene difluoride resin, and the copolymers thereof, of which ethylene tetrafluoride resin and vinylidene fluoride resin are particularly preferred. The content of the lubricant particles in the surface protection layer is preferably 5-70 parts by mass, more preferably 10-60 parts by mass with respect to 100 parts by mass of the binder resin. The number average primary particle size of the lubricant particles is preferably 0.01-1 μm, particularly 0.05-0.5 μm. The molecular weight of the resin may be arbitrary selected, and is not particularly limited.

Formation of Surface Protection Layer

The surface protection layer may be produced by mixing the crosslinkable polymerizble compound, the inorganic fine particles surface-treated with the acidic group-containing hole transporting compound, and if necessary, other materials such as the binder resin, a polymerization initiator, lubricant particles and the like so as to prepare an application liquid, applying the liquid on the surface of the photosensitive layer in a common way, drying it naturally or by heat, and curing it. The film thickness of the surface protection layer is preferably 0.2-10 μm, more preferably 0.5-6 μm.

Solvent

Solvents that can be used for forming the surface protection layer include, but are not limited to, methanol, ethanol, 1-propanol, 2-propanol, 1-buthanol, 2-buthanol, 2-methyl-2-propanol, benzylalcohol, methylisopropylketone, methylisobutylketone, methylethylketone, cyclohexane, toluene, xylene, methylene chloride, ethyl acetate, butyl acetate, 2-methoxyethanol, 2-ethoxyethanol, tetrahydrofuran, 1-dioxane, 1,3-dioxolane, pyridine, diethylamine and the like.

Polymerization Initiator

The crosslikable polymerizable compounds that can be used for the surface protection layer of the present invention can be polymerized by a method that uses an electron beam for cleavage or by a method that uses light or heat under the presence of a radical polymerization initiator. If a radical polymerization initiator is used for the polymerization reaction, it may be either photopolymerization initiator or thermalpolymerization initiator. Also, both initiators may be used in combination.

Polymerization initiators that can be used for the surface protection layer of the present invention include thermalpolymerization initiators including azo compounds such as 2,2'-azobisisobutyronitrile, 2,2'-azobis(2,4-dimethylazobisvaleronitril) and 2,2'-azobis(2-methylbutyronitrile), peroxides such as benzoyl peroxide (BPO), di-tert-butylhydroperoxide, tert-butylhydroperoxide, chlorobenzoyl peroxide, dichlorobenzoyl peroxide, bromomethylbenzoyl peroxide and lauroyl peroxide, and the like.

Photopolymerization initiators that can be used include acetophenone or ketal photopolymerization initiators such as diethoxyacetophenone, 2,2-dimethoxy-1,2-diphenylethane-1-on, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanon-1 (IRGACURE 369: BASF Japan, Ltd), 2-hydroxy-2-methyl-1-phenylpropane-1-on, 2-methyl-2-morpholino(4-methylthiophenyl)propane-1-on and 1-phenyl-1,2-propanedione-2-(o-ethoxycarbonyl)oxime; benzoinether photopolymerization initiators such as benzoin, benzoin methylether, benzoin ethylether, benzoin isobutylether and benzoin isopropylether; benzophenone photopolymeriztion initiators such as benzophenone, 4-hydroxybenzophenone, o-benzoylmethylbenzoate, 2-benzoylnaphthalene, 4-benzoylbiphenyl, 4-benzoylphenylether, acrylic benzophenone and 1,4-benzoylbenzene; and thioxanthone photopolymerization initiators such as 2-isopropylthioxanthone, 2-chlorothioxanthone, 2,4-dimethylthioxanthone, 2,4-diethylthioxanthone and 2,4-dichlorothioxanthone.

Other photopolymerization initiators that can be used include ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide (IRGACURE 819, BASF Japan, Ltd.), bis(2,4-dimethoxybenzoyl)-2,4,4-trimethylpentylphosphineoxide, methylphenylglyoxylate ester, 9,10-phenanthrene, acridine compounds, triazine compounds and imidazole compounds. Further, a substance having a photopolymerization promoting effect may be used alone or in combination with the above photopolymerization initiators. Examples of such substances include triethanol amine, methyldiethanol amine, 4-dimethylamino ethylbenzoate, 4-dimethylamino isoamylbenzoate, benzoic acid (2-dimethylamino)ethyl ester, 4,4'-dimethylaminobenzophenone and the like.

Preferred polymerization initiators that are used for the surface protection layer of the present invention are photopolymerization initiators, preferably alkylphenone compounds and phosphine oxide compounds. More preferred initiators are those having an α-hydroxyacetophenone structure or an acylphosphine oxide structure.

These polymerization initiators may be used alone or in combination of two or more. The content of the polymerization initiator is preferably 0.1-20 parts by mass, preferably 0.5-10 parts by mass with respect to 100 parts by mass of the crosslinkable polymerizable compound.

Curing Method of Surface Protection Layer

In the present invention, a preferred polymerization reaction of the surface protection layer is performed such that an applied coating is irradiated with an active ray to cause polymerization as well as cross-linking reaction that forms a cross-linked structure between molecules or within a molecule by generated radicals, so as to produce a cured resin. The active ray may be light such as ultraviolet ray and visible light or an electron beam. In terms of ease in handling, an ultraviolet ray is particularly preferred.

The light source of an ultraviolet ray may be any light source that can emit an ultraviolet ray. For example, a low-pressure mercury lamp, a medium-pressure mercury lamp, a high-pressure mercury lamp, an ultrahigh-pressure mercury lamp, a carbon arc lamp, a metal halide lamp, a xenon lamp, a xenon flush (pulse) lamp, an ultraviolet LED and the like can be used. The irradiation condition depends on lamps, but the irradiation amount of an active ray is normally 1-20 $mJ/cm^2$, preferably 5-15 $mJ/cm^2$. The output voltage of the light source is preferably 0.1-5 kW, more preferably 0.5-3 kW.

The light source of an electron beam may be any electron beam irradiation device. Typically, a curtain-type electron beam accelerator is effectively used for electron beam irradiation of this purpose because of the relatively low cost and high power output. The acceleration voltage of the electron beam irradiation is preferably 100-300 kV. The absorbed irradiation is preferably ranging from 0.005 Gy to 100 kGy (from 0.5 rad to 10 Mrad).

The irradiation time of an active ray is based on the irradiation amount of the active ray required. Specifically, the irradiation time is preferably ranging from 0.1 sec to 10 min, more preferably ranging from 1 sec to 5 min in terms of polymerization efficiency or work efficiency.

In the present invention, a drying step of the surface protection layer may be performed before, after or during the irradiation of an active ray. The timing of the drying step may be suitably selected according to the irradiation condition of the active ray. The drying condition of the surface protection layer may be suitably selected according to the type of solvent used in the application liquid, the film thickness of the surface protection layer, and the like. The drying temperature is preferably ranging from room temperature to 180° C., particularly from 80° C. to 140° C. The drying time is preferably 1-200 min, particularly 5-100 min. In the present invention, it is possible to control the content of solvent in the surface protection layer in the range from 20 ppm to 75 ppm by drying the surface protection layer in the above-described drying conditions.

By providing the surface protection layer on the photosensitive layer as described above, it is possible to improve the hardness and the abrasion resistance of the photoreceptor surface so as to improve the durability.

Next, the components of the photoreceptor of the present invention other than the surface protection layer will be described.

Conductive Support

The support of the present invention may be any conductive support. Examples of such supports include a drum or sheet of metal such as aluminum, copper, chromium, nickel, zinc, stainless or the like, a plastic film laminated with a metal foil of aluminum, copper or the like, a plastic film with a vapor-deposition coating of aluminum, indium oxide, tin oxide or the like, a metal, plastic or paper body with a conductive layer that is formed by applying a conductive material alone or together with a binder resin.

Intermediate Layer

In the present invention, the intermediate layer having a barrier function and an adhesion function may be provided between the conductive support and the photosensitive layer.

The intermediate layer may be formed by dissolving a binder resin such as casein, polyvinylalcohol, nitrocellulose, ethylene-acrylate copolymer, polyamide, polyurethane and gelatin in a solvent known in the art, and forming the layer by immersion or application. Among them, alcohol-soluble polyamide resins are preferred.

Further, in order to adjust the resistance, the intermediate layer may contain inorganic fine particles such as various types of metal oxide fine particles. Examples of inorganic fine particles that can be used include metal oxide fine particles of alumina, zinc oxide, titanium oxide, tin oxide, antimony oxide, indium oxide, bismuth oxide or the like, ultrafine particles of tin-doped indium oxide, antimony-doped tin oxide, zirconium oxide and the like.

These inorganic fine particles may be used alone or in combination of two or more. If two or more types of particles are mixed, they may form a solid solution or may be fused with each other. The average particle size of such inorganic fine particles is preferably 0.3 μm or less, more preferably 0.1 μm or less.

It is preferred that the solvent used for the intermediate layer is capable of dispersing inorganic fine particle such as metal oxide inorganic fine particles well and dissolving polyamide resins. Specifically, alcohols of 2-4 carbon atoms such as ethanol, n-propylalcohol, isopropylalcohol, n-butanol, t-butanol and sec-butanol are preferred because of high polyamide resin solubility and good application compatibility. Further, in order to improve the preservability and the dispersibility of fine particles, an auxiliary solvent may be used in combination with the solvent. Examples of auxiliary solvents that can bring about a favorable effect include methanol, benzylalcohol, toluene, methylenechloride, cyclohexanone, tetrahydrofuran and the like.

The concentration of the binder resin is suitably selected according to the film thickness of the intermediate layer and the production rate.

If inorganic fine particles or the like are dispersed, the mixing proportion of the inorganic fine particles with respect to the binder resin is preferably 20-400 parts by mass, more preferably 50-200 parts by mass of the inorganic fine particles with respect to 100 parts by mass of the binder resin.

To disperse the inorganic fine particles, an ultrasonic dispersing machine, a ball mill, a sand grinder, a homo mixers or the like can be used, but the dispersing means is not limited thereto.

The drying method of the applied intermediate layer may be suitably selected according to the type of the solvent and the film thickness, and thermal drying is preferred.

The film thickness of the intermediate layer is preferably 0.1-15 μm, more preferably 0.3-10 μm.

Charge Generating Layer

It is preferred that the charge generating layer used in the present invention contains a charge generating material and a binder resin, and it is formed by dispersing the charge generating material in a binder resin solution and applying it.

The charge generating materials known in the art can be used. Such charge generating materials include, but are not limited to, azo materials such as Sudan Red and Dyan Blue, quinine pigments such as pyrenequinone and anthanthrone, quinocyanine pigments, perylene pigments, indigo pigments such as indigo and thioindigo, phthalocyanine pigments and the like. These charge generating materials may be used alone or in the form of dispersion in a resin known in the art.

Resins known in the art can be used as the binder resin of the charge generating layer. Examples of such resins include, but are not limited to, polystyrene resin, polyethylene resin, polypropylene resin, acrylic resin, methacrylic resin, vinyl chloride resin, vinyl acetate resin, polyvinylbutyral resin, epoxy resin, polyurethane resin, phenol resin, polyester resin, alkyd resin, polycarbonate resin, silicone resin, melamine resin, the copolymers including two or more of these resins (e.g. vinyl chloride-vinyl acetate copolymer resin, vinyl chloride-vinyl acetate-maleic anhydride copolymer resin), polyvinylcarbazole resin and the like.

It is preferred that the charge generating layer is produced by dispersing the charge generating material in a solution of the binder resin in a solvent by means of a dispersing machine to prepare an application liquid, applying the liquid by means of an coater to form a film having an uniform thickness, and drying the applied film.

Examples of solvents that can be used for dissolving and applying the binder resin of the charge generating layer include, but are not limited to, toluene, xylene, methylene chloride, 1,2-dichloroethane, methylethylketone, cyclohexane, ethyl acetate, butyl acetate, methanol, ethanol, propanol, butanol, methylcellosolve, ethylcellosolve, tetrahydrofuran, 1-dioxane, 1,3-dioxolane, pyridine, diethylamine and the like.

To disperse the charge generating material, an ultrasonic dispersing machine, a ball mill, a sand grinder, and a homo mixer or the like can be used. However, the dispersing means is not limited thereto.

The mixing proportion of the charge generating material with respect to the binder resin is preferably 1-600 parts by mass, more preferably 50-500 parts by mass of the charge generating material with respect to 100 parts by mass of the binder resin. The film thickness of the charge generating layer is preferably 0.01-5 μm, more preferably 0.05-3 μm, although it varies depending on the properties of the charge generating material, the properties of the binder resin, the mixing proportion and the like. By filtrating the application liquid of the charge generating layer for removing impurities and aggregates before applying it, it is possible to prevent image defects. The charge generating layer may also be formed by vacuum deposition of the above-described pigments.

Charge Transporting Layer

The charge transporting layer of the photoreceptor of the present invention contains a charge transporting material (CTM) and a binder resin, and it is formed by dissolving the charge transporting material in a binder resin solution and applying it.

Charge transporting materials known in the art can be used. Examples of such charge transporting materials include carbazole derivatives, oxazole derivatives, oxadiazole derivatives, triazole derivatives, thiadiazole derivatives, triazole derivatives, imidazole derivatives, imidazolone derivatives, imidazolidine derivatives, bisimidazolidine derivatives, stylyl compounds, hydrazone compounds, pyrazoline compounds, oxazolone derivatives, benzimidazole derivatives, quinazoline derivatives, benzofuran derivatives, acridine derivatives, phenazine derivatives, aminostilbene derivatives, triarylamine derivatives, phenylenediamine derivatives, stilbene derivatives, benzidine derivatives, poly-N-vinylcarbazole, poly-1-vinylpyrene, poly-9-vinylanthracene, triphenylamine derivatives and the like. They may be used in combination of two or more.

Resins known in the art can be used for the binder resin of the charge transporting layer. Such resins include polycarbonate resin, polyacrylate resin, polyester resin, polystylene resin, stylene-acrylonitrile copolymer resin, polymethacrylate resin, stylene-methacrylate copolymer resin and the like, of which polycarbonate is preferred. Furthermore, BPA, BPZ, dimethyl BPA, BPA-dimetyl BPA copolymer and the like are preferred in terms of anti-crack property, abrasion resistance and charging properties.

It is preferred that the charge transporting layer is produced by dissolving the binder resin and the charge transporting material to prepare an application liquid, applying the liquid by means of a coater to form a film having an uniform thickness, and drying the applied film.

Examples of solvents that can be used for dissolving the binder resin and the charge transporting material include, but are not limited to, toluene, xylene, methylene chloride, 1,2-dichloroethane, methylethylketone, cyclohexane, ethyl acetate, butyl acetate, methanol, ethanol, propanol, butanol, tetrahydrofuran, 1,4-dioxane, 1,3-dioxolane, pyridine, diethylamine and the like.

The mixing proportion of the charge transporting material with respect to the binder resin is preferably 10-500 parts by mass, more preferably 20-100 parts by mass of the charge transporting material with respect to 100 parts by mass of the binder resin.

The film thickness of the charge transporting layer is preferably 5-40 μm, more preferably 10-30 μm, although it varies depending on the properties of the charge transporting material, the properties of the binder resin, the mixing proportion and the like.

An antioxidant, an electron conductor agent, a stabilizer or the like may be added to the charge transporting layer. Preferred antioxidants are set forth in JP H11-200135A and the like. Preferred electron conductor agents are set forth in JP S50-137543A, JP S58-76483A and the like.

Application Method of Photoreceptor

Each of the intermediate layer, the charge generating layer, charge transporting layer, the surface protection layer and the like, of which the photoreceptor of the present invention is composed, can be formed by an application method known in the art. Specifically, such methods include immersion coating, spray coating, spinner coating, bead coating, blade coating, beam coating, circular quantity control coating (circular slide hopper coating) and the like. Circular quantity control coating is set forth in, for example, JP 558-189061A and JP 2005-275373A.

Electrophotographic Image Forming Apparatus

Figure 2:
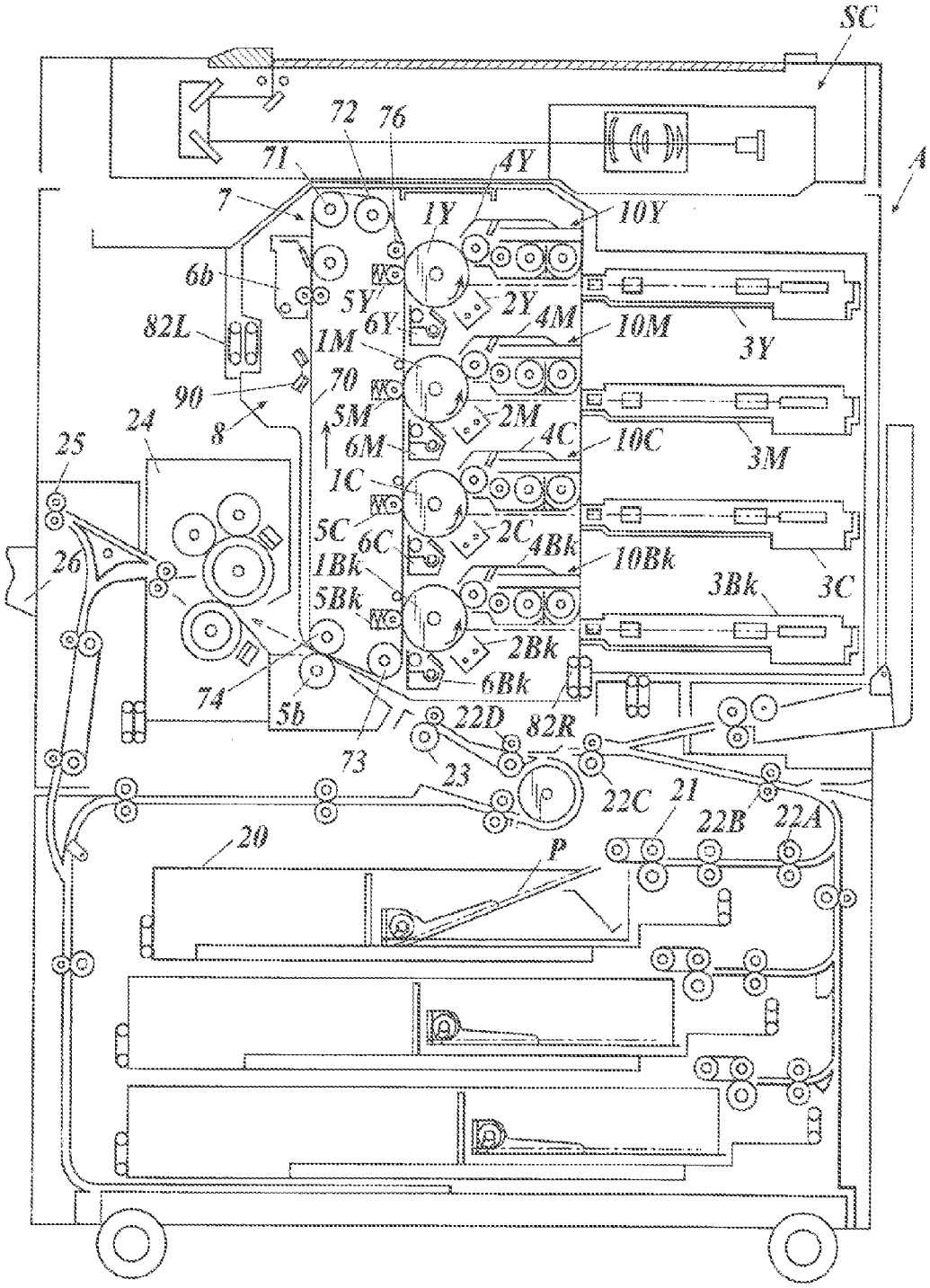
FIG. 2 is a cross sectional configuration view of an exemplary full-color electrophotographic image forming apparatus according to an embodiment of the present invention.

Next, the electrophotographic image forming apparatus using the organic photoreceptor of the present invention will be described. FIG. 2 is a cross sectional configuration view of an exemplary full-color electrophotographic image forming apparatus according to an embodiment of the present invention.

The color image forming apparatus, which is of the type called a tandem color image forming apparatus, includes four image forming sections (image forming units) 10Y, 10M, 10C and 10Bk, an endless belt intermediate transfer body unit 7*a*, a paper feeding/conveying unit 21 and a fixing unit 24. In the upper part of a body A of the image forming apparatus, a document image scanner SC is provided.

The image forming section 10Y for forming a yellow image includes a drum photoreceptor 1Y as a first image carrier, and a charging unit (charging step) 2Y an exposing unit (exposing step) 3Y, a developing unit (developing step) 4Y, a primary transfer roller 5Y as a primary transferring unit (primary transferring step), and a cleaning unit 6Y that are provided surrounding the photoreceptor 1Y. The image forming section 10M for forming an magenta image includes a drum photoreceptor 1M as a first image carrier, a charging unit 2M, an exposing unit 3M, a developing unit 4M, a primary transfer roller 5Y as a primary transferring unit, and a cleaning unit 6M. The image forming section 10C for forming a cyan image includes a drum photoreceptor 1C as a first image carrier, a charging unit 2C, an exposing unit 3C, a developing unit 4C, a primary transfer roller 5C as a primary transferring unit, and a cleaning unit 6C. The image forming section 10Bk for forming a black image includes a drum photoreceptor 1Bk as a first image carrier, a charging unit 2Bk, an exposing unit 3Bk, a developing unit 4Bk, a primary transfer roller 5Bk as a primary transferring unit, and a cleaning unit 6Bk.

The four image forming units 10Y, 10M, 10C and 10Bk include, respectively, the photoreceptors 1Y, 1M, 1C and 1Bk at the respective centers, the charging unit 2Y, 2M, 2C and 2Bk, the exposing unit 3Y, 3M, 3C and 3Bk, the developing unit 4Y, 4M, 4C and 4Bk, and the cleaning unit 6Y, 6M, 6C and 6Bk for cleaning the photoreceptors 1Y, 1M, 1C and 1Bk.

The image forming units 10Y, 10M, 10C and 10Bk have the same configuration except for the color of toner images formed on the respective photoreceptors 1Y, 1M, 1C and 1Bk. For the following detailed description, the image forming unit 10Y is taken as an example.

The image forming unit 10Y is configured such that the charging unit 2Y (hereinafter, also referred to as the charging section 2Y), the exposing unit 3Y, the developing unit 4Y and the cleaning unit 6Y are arranged surrounding the photoreceptor 1Y which serves an image forming body so as to form a yellow (Y) toner image on the photoreceptor 1Y. In this embodiment, at least the photoreceptor 1Y, the charging unit 2Y, the developing unit 4Y and the cleaning unit 6Y of the image forming unit 10Y are integrally provided.

The charging unit 2Y charges the photoreceptor 1Y at a uniform potential. In this embodiment, the corona discharge charging section 2Y is used in the photoreceptor 1Y.

The exposing unit 3Y exposes the photoreceptor 1Y which the charging section 2Y has charged at a uniform potential to light based on an image signal (yellow), and forms an electrostatic latent image corresponding to a yellow image. The exposing unit 3Y may be composed of an array of LEDs aligned in the axis direction of the photoreceptor 1Y and focusing elements (SELFOC (trade name, registered trademark) lenses), or may be composed of a laser optical system.

The endless belt intermediate transfer unit 7*a* includes an endless belt intermediate transfer body 70 that is guided and rotatably supported by a plurality of rollers, and serves as an endless belt semiconductive secondary image carrier.

Respective color images formed by the image forming units 10Y, 10M, 10C and 10Bk are sequentially transferred onto the rotating endless belt intermediate transfer body 70 by the primary transfer rollers 5Y, 5M, 5C and 5Bk that serve as primary transferring unit so that a composite color image is formed. A transfer object P (a support that carries a fixed final image, e.g. a normal paper, a transparent sheet, etc.), which is housed in a paper feeder cassette 20, is fed by a feeding unit 21, and is conveyed through a plurality of intermediate rollers 22A, 22B, 22C and 22D and a resist roller 23 to a secondary transfer roller 5*b* that serves as a secondary transfer unit. A color image is then collectively transferred onto the transfer object P (secondary transfer). The transfer object P on which the color image has been transferred is subject to a fixing treatment by the fixing unit 24, and is then moved to an eject tray 26 by being sandwiched by eject rollers 25. As used herein, supports of a transferred toner image that is originally formed on the photoreceptor, such as the intermediate transfer body and the transfer object, collectively refer to transfer media.

After the color image is transferred to the transfer object P by the secondary transfer roller 5*b* that serves as the secondary transfer unit, the cleaning unit 6*b* cleans the endless belt intermediate transfer body 70 that has released the transfer object P by self stripping so as to remove residual toner.

During any image forming process, the primary transfer roller 5Bk always abuts the photoreceptor 1Bk. The other primary transfer rollers 5Y, 5M and 5C abut the respective photoreceptors 1Y, 1M and 1C only during a color image forming process.

The secondary transfer roller 5*b* abuts the endless belt intermediate transfer body 70 only while the transfer object P is passing through it for the secondary transfer.

Further, a housing 8 can be pulled out from the apparatus body A using guide rails 82L and 82R.

The housing 8 is composed of the image forming sections 10Y, 10M, 10C and 10Bk and the endless belt intermediate transfer body unit 7*a*.

The image forming sections 10Y, 10M, 10C and 10Bk are aligned in the vertical direction. The endless belt intermediate transfer body unit 7*a* is provided on the left side of the photoreceptors 1Y, 1M, 1C and 1Bk in the figure. The endless belt intermediate transfer body unit 7*a* includes the endless belt intermediate transfer body 70 that is rotatably guided by the rollers 71, 72, 76, 73 and 74, the primary transfer rollers 5Y, 5M, 5C and 5Bk and the cleaning unit 6*b*.

Process Cartridge

The electrophotographic image forming apparatus of the present invention may also be configured such the photoreceptor of the present invention is integrally formed with at least one of the charging unit (charging section), the exposing unit (exposing section) and the developing unit (developing section) as a process cartridge (image forming unit) that is attachable to the electrophotographic image forming apparatus body. Further, in addition to the charging unit, exposing unit and developing unit, the photoreceptor may be integrally formed also with at least one of the transfer unit (transfer section), a releasing unit (releasing section) and the cleaning unit (cleaning section) as a single process cartridge (image forming unit) that is attachable to the apparatus body using a guide unit such as a rail of the apparatus body.

The electrophotographic image forming apparatus of the present invention is generally applicable to electrophotographic image forming apparatuses such as electrophotographic copiers, laser printers, LED printers and liquid crystal shutter printers. Furthermore, it is widely applicable to apparatuses that use electrophotographic techniques, such as displays, recorders, light printing apparatuses, printmaking apparatuses and facsimiles.

Embodiments

Hereinafter, the present invention will be specifically described with examples. However, it is not intended that the present invention is limited to these examples. In the following description of examples, the terms "part(s)" and "%" refer to "part(s) by mass" and "mass %" respectively, unless otherwise indicated.

Production of Photoreceptor

Production of Surface-Treated Inorganic Fine Particles (1)

Inorganic fine particles surface-treated with an acidic group-containing hole transporting compound (surface-treated inorganic fine particles) were produced as follows.

Into a wet sand mill (alumina beads, particle size of 0.5 mm), 100 parts by mass of "titanium oxide" having a number average primary particle size of 6 nm as the inorganic fine particles, 10 parts by mass of HTM-1 as the surface treatment agent and 1000 parts by mass of methylethylketone were charged, and the mixture was stirred at a rotation speed of 1000 rpm at 30° C. for 1 hour. Thereafter, the mixture was filtrated to separate the metylethylkeone mixture from the alumina beads. The mixture was centrifuged to separate titanium oxide particles from methylethylkenote, and the separated particles were dried at 80° C. Surface-Treated Inorganic Fine Particles (1), which are titanium oxide fine particles surface-treated with the acidic group-containing hole transporting compound HTM-1, were thus produced.

Production of Surface-Treated Inorganic Fine Particles (2) to (29)

Surface-Treated Inorganic Fine Particles (2) to (29) were produced in the same manner as Surface-Treated Inorganic Fine Particles (1) except that the type and amount of the acidic group-containing hole transporting compound were changed as listed in table 1.

Production of Surface-Treated Inorganic Fine Particles (30) and (31)

Surface-Treated Inorganic Fine Particles (30) and (31) were produced in the same manner as Surface-Treated Inorganic Fine Particles (1) except that methylhydrogen polysiloxane and 4-[2-(triethoxysilyl)ethyl]triphenylamine were respectively used in place of the acidic group-containing hole transporting compound, and the type of the inorganic fine particles and the component ratio were changed as listed in table 1.

TABLE 1

| SURFACE-TREATED INORGANIC FINE PARTICLES | | | | HOLE TRANSPORTING |
|---|---|---|---|---|
| INORGANIC FINE PARTICLES NO. | TYPE | NUMBER AVERAGE PRIMARY PARTICLE SIZE [nm] | HOLE TRANSPORTING COMPOUND | COMPOUND/INORGANIC FINE PARTICLES (PARTS BY MASS)/(PARTS BY MASS) |
| 1 | TITANIUM OXIDE | 6 | HTM-1 | 10/100 |
| 2 | TITANIUM OXIDE | 6 | HTM-1 | 20/100 |
| 3 | TITANIUM OXIDE | 10 | HTM-11 | 50/100 |
| 4 | ZINC OXIDE | 6 | HTM-1 | 10/100 |
| 5 | ZINC OXIDE | 6 | HTM-2 | 10/100 |
| 6 | ALUMINA | 6 | HTM-5 | 20/100 |
| 7 | TIN OXIDE | 6 | HTM-2 | 10/100 |
| 8 | TIN OXIDE | 6 | HTM-13 | 5/100 |
| 9 | TIN OXIDE | 6 | HTM-5 | 30/100 |
| 10 | TIN OXIDE | 10 | HTM-6 | 10/100 |
| 11 | TITANIUM OXIDE | 10 | HTM-13 | 7/100 |
| 12 | TITANIUM OXIDE | 20 | HTM-15 | 5/100 |
| 13 | TITANIUM OXIDE | 50 | HTM-18 | 1/100 |
| 14 | ALUMINA | 10 | HTM-13 | 10/100 |
| 15 | ALUMINA | 10 | HTM-27 | 30/100 |
| 16 | TIN OXIDE | 10 | HTM-22 | 20/100 |
| 17 | TIN OXIDE | 6 | HTM-25 | 10/100 |
| 18 | TIN OXIDE | 6 | HTM-21 | 30/100 |
| 19 | TIN OXIDE | 6 | HTM-5 | 15/100 |
| 20 | TIN OXIDE | 6 | HTM-9 | 20/100 |
| 21 | ZINC OXIDE | 6 | HTM-32 | 7/100 |
| 22 | TIN OXIDE | 6 | HTM-30 | 10/100 |
| 23 | TIN OXIDE | 6 | HTM-36 | 30/100 |
| 24 | TIN OXIDE | 6 | HTM-50 | 20/100 |
| 25 | TITANIUM OXIDE | 6 | HTM-27 | 20/100 |
| 26 | TITANIUM OXIDE | 6 | HTM-41 | 100/100 |
| 27 | TITANIUM OXIDE | 6 | HTM-41 | 0.5/100 |
| 28 | TITANIUM OXIDE | 6 | HTM-13 | 30/100 |
| 29 | TIN OXIDE | 6 | HTM-13 | 30/100 |
| 30 | TITANIUM OXIDE | 6 | MHPS | 100/100 |
| 31 | TITANIUM OXIDE | 6 | HTM-A | 100/100 |

MHPS: METHYLHYDROGEN POLYSILOXANE

HTMA: 4-[2-(TRIETHOXYSILYL)ETHYL]TRIPHENYLAMINE

Production of Photoreceptor 1

Photoreceptor 1 was produced as follows. A cylindrical aluminum support with a machined surface was prepared as a conductive support.

(Intermediate Layer)

An intermediate layer application liquid of the following composition was prepared.

Binder resin: polyamide resin "X1010" (Daicel-Evonik Ltd.), 1.0 part by mass

Metal oxide fine particles: titanium dioxide "SMT500SAS" (Tayca, Corporation.), 1.1 parts by mass Solvent: ethanol, 20 parts by mass Using a sand mill as a dispersing machine, the mixture was subject to a batch dispersion treatment for 10 hours.

The resulting application liquid was applied on the support by immersion application so that the film thickness became 2 μm after dried at 110° C. for 20 min.

(Charge Generating Layer)

Charge generating material: titanylphthalocyanine pigment (titanylphthalocyanine pigment having a maximum diffraction peak at least at 27.3° measured by Cu-Kα characteristic X-ray spectrometry), 20 parts by mass Binder resin: polyvinylbutyral resin "#6000-C" (Denki Kagaku Kogyo Kabushiki Kaisha), 10 parts by mass Solvent: t-butyl acetate, 700 parts by mass, and 4-methoxy-4-methyl-2-pentanone, 300 parts by mass The above materials were mixed and dispersed for 10 hours using a sand mill so as to prepare a charge generating layer application liquid. The resulting application liquid was applied on the above-described intermediate layer by immersion application so as to form a charge generating layer having a dried film thickness of 0.3 μm.

(Charge Transporting Layer)

Charge transporting material: CTM, the following Compound A, 150 parts by mass

Binder: polycarbonate "Z300" (Mitsubishi Gas Chemical Company, Inc), 300 parts by mass Antioxidant: "IRGANOX (registered trademark) 1010" (BASF Japan, Ltd.), 6 parts by mass Solvent: toluene/tetrahydrofuran=1/9 (volume ratio), 2000 parts by mass Additive: silicone oil "KF-54" (Shin-Etsu Chemical Co., Ltd.), 1 part by mass The above materials were mixed and dissolved so as to prepare a charge transporting layer application liquid. The resulting application liquid was applied on the above-described charge generating layer by immersion application, and was dried at 110° C. for 60 min. A charge transporting layer having a film thickness of 20 μm was thus formed.

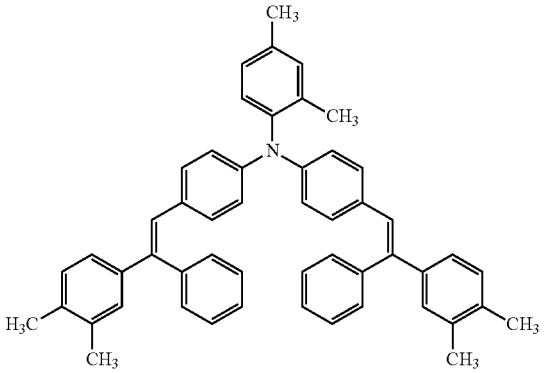

(Surface Protection Layer)

Inorganic fine particles surface-treated with an acidity group-containing hole transporting compound: Surface-Treated Inorganic Fine Particles (1), 100 parts by mass Polymerizable compound: the exemplary compound "Mc-1", 100 parts by mass Solvent: isopropylalcohol, 500 parts by mass After the above materials were dispersed for 10 hours using a sand mill, 8 parts by mass of Polymerization Initiator (1) (bis(2,4,6-trimethylbenzoyl)-phenylphosphine oxide "IRGACURE 819" (BASF Japan, Ltd.)) was added thereto, and the mixture was stirred in the dark to dissolve it, so as to prepare a surface protection layer application liquid (stored in the dark). Using a circular slide hopper coater, the resultant application liquid was applied on a photoreceptor on which the charge transporting layer and the lower layers were previously formed so as to form a surface protection layer. The applied layer was dried at room temperature for 20 min (solvent drying step) after the application. Then, the photoreceptor was irradiated with ultraviolet light while rotating it using a metal halide lamp (500 W) at a distance of 100 mm for 1 min (ultraviolet curing step). A surface protection layer having a film thickness of 3 μm was thus obtained.

Polymerization initiators that were used in the production of surface protection layers are listed below.

Polymerization Initiator (1): bis(2,4,6-trimethylbenzoyl)-phenylphosphine oxide

Polymerization Initiator (2): 1-(4-morpholinophenyl)-2-(dimethylamino)-2-(4-methylbenzyl)-1-butanone Polymerization Initiator (3): tert-butyl 2-ethylperoxyhexonate Polymerization Initiator (4): N-(trifluoromethylsulfonyloxy)norbornan-5-en-2,3-dicarboxyimide Polymerization Initiator (5): 1-(trifluoromethylsulfonyloxy)-3,3-dimethylbicyclo[2.2.1]heptane-2-on Polymerization Initiator (1)

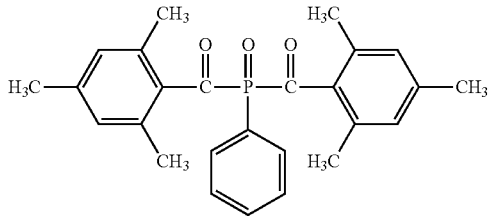

Polymerization Initiator (2) Polymerization Initiator (3)

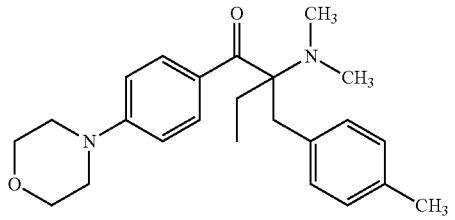

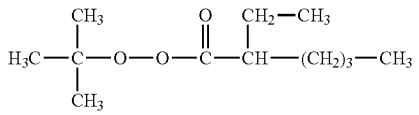

Polymerization Initiator (4) Polymerization Initiator (5)

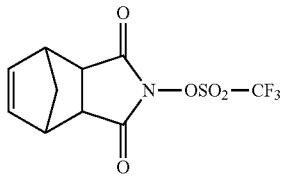

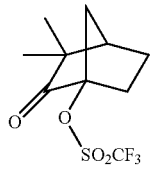

Production of Photoreceptors 2 TO 27

Photoreceptors 2 to 27 were produced in the same manner as Photoreceptor 1 except that the materials and polymerization condition of the surface protection layer were changed as listed in table 2.

Production of Photoreceptor 28

Photoreceptor 28 was produced in the same manner as Photoreceptor 1 except that the surface protection layer was formed as follows.

(Surface Protection Layer)

Inorganic fine particles surface-treated with an acidic group-containing hole transporting compound: Surface-Treated Inorganic Fine Particles (28), 100 parts by mass Binder: polycarbonate "Z300" (Mitsubishi Gas Chemical Company, Inc.), 100 parts by mass Solvent: isopropylalcohol, 500 parts by mass The above materials were dispersed for 10 hours using a sand mill so as to prepare a surface protection layer application liquid. Using a circular slide hopper coater, the resulting application liquid was applied on a photoreceptor on which the charge transporting layer and the lower layers were previously formed, so as to form a surface protection layer. After the application, the layer was dried at 100° C. for 50 min. A surface protection layer having a film thickness of 3 μm was thus obtained.

Production of Photoreceptor 29

Photoreceptor 29 was produced in the same manner as Photoreceptor 1 except that the surface protection layer was formed as follows.

(Surface Protection Layer)

Inorganic fine particles surface-treated with an acidic group-containing hole transporting compound: Surface-Treated Inorganic Fine Particles (29), 100 parts by mass Binder: polyarylate "U-100" (Unitika, Ltd.), 100 parts by mass Solvent: isopropylalcohol, 500 parts by mass The above materials were dispersed for 10 hours using a sand mill so as to prepare a surface protection layer application liquid. Using a circular slide hopper coater, the resulting application liquid was applied on a photoreceptor on which a charge transporting layer and the lower layers were previously formed, so as to form a surface protection layer. After the application, the layer was dried at 100° C. for 50 min. A surface protection layer having a film thickness of 3 μm was thus obtained.

Production of Photoreceptor 30 (for comparison)

Comparative Photoreceptor 30 was produced in the same manner as Photoreceptor 1 except that Surface-Treated Inorganic Fine Particles (2) of the surface protection layer was changed to Surface-Treated Inorganic Fine Particles (30) (titanium oxide fine particles surface-treated with methylhydrogen polysiloxane), and the type and amount of the polymerizable compound and polymerization initiator were changed as listed in table 2.

Production of Photoreceptor 31 (for Comparison)

Comparative Photoreceptor 31 was produced in the same manner as Photoreceptor 1 except that Surface-Treated Inorganic Fine Particles (2) of the surface protection layer was changed to Surface-Treated Inorganic Fine Particles (31) (titanium oxide fine particles surface-treated with 4-[2-(triethoxysilyl)ethyl]triphenylamine), and the type and amount of the polymerizable compound and polymerization initiator were changed as listed in table 2.

Production of Photoreceptor 32 (for Comparison)

Comparative Photoreceptor 32 was produced in the same manner as Photoreceptor 1 except that Surface-Treated Inorganic Fine Particles (2) of the surface protection layer was changed to the Surface-Treated Inorganic Fine Particles (31) (titanium oxide fine particles surface-treated with 4-[2-(triethoxysilyl)ethyl]triphenylamine), and the type and amount of the polymerizable compound and polymerization initiator were changed as listed in table 2.

Production of Photoreceptor 33 (for Comparison)

Comparative Photoreceptor 33 was produced in the same manner as Photoreceptor 2 except that no surface-treated inorganic fine particle was added to the surface protection layer.

In the production of Photoreceptors 1 to 33, the polymerization reaction (curing reaction) of the surface protection layers was performed by either photopolymerization or thermal polymerization. The conditions of each polymerization method are as follows.

Polymerization conditions (light): After the applied layer was dried for 20 min, the photoreceptor was irradiated with light while rotating it using a metal halide lamp (500 W) at a distance of 100 mm for 1 min. A surface protection layer having a film thickness of 3 μm was thus obtained.

Polymerization conditions (heat): The layer was heated at 140° C. for 30 min. A surface protection layer having a film thickness of 3 μm was thus obtained.

TABLE 2

| PHOTO-RECEPTOR NO. | SURFACE-TREATED INORGANIC FINE PARTICLES NO. | SURFACE-TREATED INORGANIC FINE PARTICLES AMOUNT (PARTS BY MASS) | POLYMERIZABLE COMPOUND EXEMPLARY COMPOUND | POLYMERIZABLE COMPOUND AMOUNT (PARTS BY MASS) | POLYMERIZABLE COMPOUND NUMBER OF FUNCTIONAL GROUP(S) | POLYMERIZATION INITIATOR EXEMPLARY COMPOUND | POLYMERIZATION INITIATOR AMOUNT (PARTS BY MASS) | POLYMERIZATION CONDITION | REMARKS |
|---|---|---|---|---|---|---|---|---|---|
| 1 | [1] | 100 | Mc-1 | 100 | 3 | [1] | 8 | LIGHT | INVENTION |
| 2 | [2] | 100 | Ac-31 | 100 | 4 | [1] | 7 | LIGHT | INVENTION |

TABLE 2-continued

| PHOTO-RECEPTOR NO. | SURFACE-TREATED INORGANIC FINE PARTICLES NO. | AMOUNT (PARTS BY MASS) | POLYMERIZABLE COMPOUND EXEMPLARY COMPOUND | AMOUNT (PARTS BY MASS) | NUMBER OF FUNCTIONAL GROUP(S) | POLYMERIZATION INITIATOR EXEMPLARY COMPOUND | AMOUNT (PARTS BY MASS) | POLYMERIZATION CONDITION | REMARKS |
|---|---|---|---|---|---|---|---|---|---|
| 3 | [3] | 120 | Ac-1 | 100 | 3 | [2] | 8 | LIGHT | INVENTION |
| 4 | [4] | 100 | Mc-1 | 100 | 3 | [3] | 0.5 | HEAT | INVENTION |
| 5 | [5] | 130 | Mc-1 | 100 | 3 | [2] | 8 | LIGHT | INVENTION |
| 6 | [6] | 100 | Mc-1 | 100 | 3 | [2] | 5 | LIGHT | INVENTION |
| 7 | [7] | 145 | Mc-1 | 100 | 3 | [1] | 8 | LIGHT | INVENTION |
| 8 | [8] | 150 | Mc-1 | 100 | 3 | [1] | 10 | LIGHT | INVENTION |
| 9 | [9] | 140 | Mc-1 | 100 | 3 | [2] | 5 | LIGHT | INVENTION |
| 10 | [10] | 100 | Mc-7 | 100 | 6 | [3] | 1 | HEAT | INVENTION |
| 11 | [11] | 120 | Ac-31 | 100 | 4 | [2] | 20 | LIGHT | INVENTION |
| 12 | [12] | 135 | Mc-1 | 100 | 3 | [1] | 10 | LIGHT | INVENTION |
| 13 | [13] | 90 | Mc-1 | 100 | 3 | [2] | 3 | LIGHT | INVENTION |
| 14 | [14] | 100 | Mc-1 | 100 | 3 | [1] | 15 | LIGHT | INVENTION |
| 15 | [15] | 120 | Mc-1 | 100 | 3 | [2] | 10 | LIGHT | INVENTION |
| 16 | [16] | 150 | Ac-1 | 100 | 3 | [1] | 8 | LIGHT | INVENTION |
| 17 | [17] | 150 | Ac-7 | 100 | 6 | [1] | 5 | LIGHT | INVENTION |
| 18 | [18] | 150 | Ac-31 | 100 | 4 | [1] | 7 | LIGHT | INVENTION |
| 19 | [19] | 120 | Mc-1 | 100 | 3 | [1] | 12 | LIGHT | INVENTION |
| 20 | [20] | 145 | Mc-1 | 100 | 3 | [1] | 0.5 | LIGHT | INVENTION |
| 21 | [21] | 135 | Mc-1 | 100 | 3 | [1] | 0.8 | LIGHT | INVENTION |
| 22 | [22] | 150 | Mc-1 | 100 | 3 | [2] | 1.2 | LIGHT | INVENTION |
| 23 | [23] | 150 | Mc-1 | 100 | 3 | [2] | 18 | LIGHT | INVENTION |
| 24 | [24] | 190 | Ac-31 | 100 | 4 | [2] | 5 | LIGHT | INVENTION |
| 25 | [25] | 100 | Mc-1 | 100 | 3 | [4] | 0.3 | HEAT | INVENTION |
| 26 | [26] | 100 | Mc-1 | 100 | 3 | [5] | 7 | LIGHT | INVENTION |
| 27 | [27] | 100 | Mc-1 | 100 | 3 | [5] | 18 | LIGHT | INVENTION |
| 28 | [28] | 180 | PC | — | — | — | — | — | INVENTION |
| 29 | [29] | 50 | PA | — | — | — | — | — | INVENTION |
| 30 | [30] | 100 | Ac-31 | 100 | 4 | [2] | 30 | LIGHT | FOR COMPARISON |
| 31 | [31] | 100 | Ac-31 | 100 | 4 | [2] | 30 | LIGHT | FOR COMPARISON |
| 32 | [31] | 100 | Ac-31 | 100 | 4 | [1] | 7 | LIGHT | FOR COMPARISON |
| 33 | — | NONE | Ac-31 | 100 | 4 | [1] | 7 | LIGHT | FOR COMPARISON |

PC: POLYCARBONATE
PA: POLYARYLATE

Evaluation of Photoreceptor

Each of the photoreceptors thus obtained was installed in an apparatus for evaluation, a digital full-color multi function peripheral "bizhub Pro C6501" (Konica Minolta, Inc.), which principally has the same configuration as the image forming apparatus illustrated in FIG. 2. The light source used was a semiconductor laser that emits exposure light at 780 nm.

Under a hot and humid environment (30° C., 85% RH), an A4-size full color image (the coverage rate of Y, M, C and Bk was each 2.5%) was repeatedly printed on A4 neutralized papers 700000 times. Thereafter, each photoreceptor was evaluated under the following individual conditions.

1. Fog (Evaluated in Black and White Images)

After the printing durability test of printing 700000 sheets of images under a hot and humid environment (30° C., 85% RH), the fog density was evaluated. The fog density was determined by measuring the reflection density of a white solid image using a Macbeth reflection densitometer "RD-918" (Macbeth Corp.). The reflection density was evaluated in relative density (where the density of a plain A4 paper is 0.000).

(Evaluation Criteria)

◎: The density is less than 0.010 (good).

○: The density is from 0.010 to 0.020 inclusive (practically acceptable).

X: The density is more than 0.020 (practically unacceptable).

2. Image Blur

After the printing durability test of printing 700000 sheets of images under a hot and humid environment (30° C., 85% RH), the main power of the apparatus was turned off. After 12 hours, the power was turned on. Immediately after the apparatus became ready for printing, a half-tone image (the relative reflection density measured by a Macbeth densitometer is 0.4) and a 6-dot checker image were each printed all over an A3 neutralized paper.

The condition of the printed images was observed and evaluated according to the following criteria.

(Evaluation Criteria)

◎: Image blur occurs in neither half-tone image nor checker image (good).

○: A faint low density band parallel to the longitudinal direction of the photoreceptor was observed only in the half-tone image (practically acceptable).

X: A loss of the checker image or line width shrinkage occurs due to image blur (practically unacceptable).

3. Image Memory

After the printing durability test of printing 700000 sheets of images under a hot and humid environment (30° C., 85% RH), an image composed of a solid black part on the left half and a solid white part on the right half with respect to the paper feeding direction was successively printed on ten sheets of A4 quality papers in a long edge feeding mode. Subsequently, an uniform half-tone image was printed, and calculates the difference (ΔID) between the reflection density at the part corresponding to the black solid image and the reflection density of the part corresponding to the white solid image in the half-tone image, so as to evaluate as to whether a trace of the solid black part and the solid white part was left in the printed half-tone image according to the following criteria.

The reflection density was measured using a Macbeth reflection densitometer "RD-918" (Macbeth Corp.)

(Evaluation Criteria)

◎: The ΔID is at or less than 0.05 (good).

○: The ΔID is more than 0.05 and at or less than 0.10 (practically acceptable).

X: The ΔID is more than 0.10 (practically unacceptable).

4. Surface Flaw

The surface flaw was measured before and after the printing durability test of printing 700000 sheets of images under a hot and humid environment (30° C., 85% RH). The surface condition of each photoreceptor was observed, and the condition of flaws were evaluated according to the following criteria. Photoreceptors installed in a cyan unit were evaluated.

(Evaluation Criteria)

◎: No surface flaw is caused after printing 700000 sheets (very good).

○: One to three surface flaw(s) was (were) caused after printing 700000 sheets (good).

Δ: Four or five surface flaws were caused after printing 700000 sheets (practically acceptable).

X: Six or more surface flaws were caused after printing 700000 sheets (practically unacceptable).

5. Wastage of Photoreceptor

The wastage was evaluated based on the difference in film thickness before and after the printing durability test of printing 700000 sheets of images under a hot and humid environment (30° C., 85% RH). The film thickness of each photoreceptor was measured at randomly selected ten points within an area having a uniform thickness (the area within at least 3 cm from both ends of each photoreceptor was excluded because the film thickness is likely to be uneven at both ends), and the average thereof was calculated as the film thickness of each photosensitive layer. An eddy current-type film thickness measuring device "Eddy 560C" (Helmut Fischer GmbH) was used for the measurement, and the difference in film thickness of each photoreceptor between before and after the printing durability test was measured as the wastage of film thickness.

(Evaluation Criteria)

◎: The wastage is at or less than 0.7 μm (very good).

○: The wastage is more than 0.7 μm, but no more than 1.6 μm (good).

Δ: The wastage is more than 1.6 μm, but no more than 2.0 μm (practically acceptable).

X: The wastage is more than 2.0 μm (practically unacceptable).

The evaluation results are summarized in table 3 below.

TABLE 3

| PHOTORECEPTOR NO. | EVALUATION | | | | | REMARKS |
|---|---|---|---|---|---|---|
| | FOG | IMAGE BLUR | IMAGE MEMORY | SURFACE FLAW | WASTAGE OF PHOTORECEPTOR | |
| 1 | ◎ | ◎ | ◎ | ◎ | ◎ | INVENTION |
| 2 | ◎ | ◎ | ◎ | ◎ | ◎ | INVENTION |
| 3 | ◎ | ◎ | ◎ | ◎ | ○ | INVENTION |
| 4 | ◎ | ◎ | ◎ | ◎ | ○ | INVENTION |
| 5 | ○ | ◎ | ◎ | ◎ | ○ | INVENTION |
| 6 | ◎ | ◎ | ◎ | ○ | ◎ | INVENTION |
| 7 | ◎ | ◎ | ◎ | ◎ | ◎ | INVENTION |
| 8 | ◎ | ◎ | ◎ | ◎ | ◎ | INVENTION |
| 9 | ○ | ◎ | ◎ | ◎ | ◎ | INVENTION |
| 10 | ◎ | ◎ | ◎ | ◎ | ○ | INVENTION |
| 11 | ◎ | ◎ | ◎ | ◎ | ◎ | INVENTION |
| 12 | ◎ | ◎ | ◎ | ◎ | ◎ | INVENTION |
| 13 | ◎ | ◎ | ◎ | ◎ | ○ | INVENTION |
| 14 | ○ | ◎ | ◎ | ◎ | ◎ | INVENTION |
| 15 | ○ | ○ | ◎ | ◎ | ◎ | INVENTION |
| 16 | ○ | ◎ | ◎ | ◎ | ◎ | INVENTION |
| 17 | ◎ | ◎ | ◎ | ◎ | ◎ | INVENTION |
| 18 | ◎ | ◎ | ◎ | ◎ | ◎ | INVENTION |
| 19 | ◎ | ◎ | ◎ | ◎ | ◎ | INVENTION |
| 20 | ◎ | ◎ | ◎ | ◎ | ◎ | INVENTION |
| 21 | ○ | ○ | ◎ | ◎ | ○ | INVENTION |
| 22 | ○ | ○ | ◎ | ◎ | ◎ | INVENTION |
| 23 | ○ | ○ | ◎ | ◎ | ◎ | INVENTION |
| 24 | ○ | ○ | ◎ | ◎ | ◎ | INVENTION |
| 25 | ○ | ○ | ◎ | ◎ | ○ | INVENTION |
| 26 | ○ | ○ | ○ | ◎ | ○ | INVENTION |
| 27 | ○ | ○ | ○ | ◎ | ○ | INVENTION |
| 28 | ○ | ○ | ○ | Δ | Δ | INVENTION |
| 29 | ○ | ○ | ○ | Δ | Δ | INVENTION |
| 30 | X | X | X | ○ | ○ | FOR COMPARISON |
| 31 | ◎ | ○ | X | ◎ | ◎ | FOR COMPARISON |
| 32 | ◎ | ○ | X | ◎ | ◎ | FOR COMPARISON |
| 33 | X | ○ | X | ○ | X | FOR COMPARISON |

As can be seen from the above-described results, Photoreceptors 1 to 29 of the present invention all exhibited good properties in all evaluation items, while Comparative Photoreceptors 30 to 33 were inferior to the photoreceptors of the present invention in at least one of the evaluation items.

Thus Photoreceptors 1 to 29 of the present invention has high abrasion resistance and can form high-quality electrophotographic images with no image blur even in a hot and humid environment and no image memory.

This U.S. patent application claims priority to Japanese patent application No. 2013-130328 filed on Jun. 21, 2013, the entire contents of which are incorporated by reference herein.

What is claimed is:

1. An electrophotographic photoreceptor, comprising:

a conductive support, and a photosensitive layer and a surface protection layer that are sequentially laminated on the conductive support, wherein the surface protection layer contains a binder resin and inorganic fine particles surface-treated with a hole transporting compound of the following General Formula 1, $$A\text{-}(R_1\text{-}Q_1)_k \qquad \text{[General Formula 1]}$$

where A is a hole transporting group; $Q_1$ is an acidic group; $R_1$ is a substituted or non-substituted alkylene, alkenylene or arylene group; k is a positive integer of 1 or more; and if k is an integer of 2 or more, each of $R_1$ and $Q_1$ are same or different.

2. The electrophotographic photoreceptor according to claim 1, wherein the hole transporting compound of General Formula 1 is a compound of the following General Formula 2,

[General Formula 2]

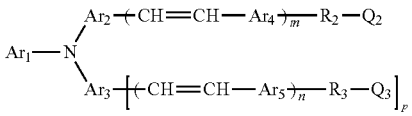

where $Ar_1$ is a substituted or non-substituted aryl group; $Ar_2$, $Ar_3$, $Ar_4$ and $Ar_5$, which are same or different, are each a substituted or non-substituted arylene group; $R_2$ and $R_3$, which are same or different, are each a substituted or non-substituted alkylene, alkenylene or arylene group; $Q_2$ and $Q_3$, which are same or different, are each an acidic group; m, n and p are each 0 or 1; and if p is 0, $Ar_3$ is a substituted or non-substituted aryl group.

3. The electrophotographic photoreceptor according to claim 2, wherein the acidic groups $Q_2$ and $Q_3$ of General Formula 2 are each a carboxyl group, a phosphonic acid group, a phosphinic acid group or a sulfonic acid group.

4. The electrophotographic photoreceptor according to claim 1, wherein the inorganic fine particles are metal oxide fine particles.

5. The electrophotographic photoreceptor according to claim 4, wherein the metal oxide fine particles are tin oxide fine particles, titanium oxide fine particles, zinc oxide fine particles or alumina fine particles.

6. The electrophotographic photoreceptor according to claim 1, wherein the binder resin contains a resin that is obtained by polymerizing a crosslinkable polymerizable compound.

7. The electrophotographic photoreceptor according to claim 6, wherein the crosslinkable polymerizable compound is a polymerizable compound having an acryloyl group or a methacryloyl group.

8. The electrophotographic photoreceptor according to claim 1, wherein the acidic group $Q_1$ of General Formula 1 is a carboxyl group, a phosphonic acid group, a phosphinic acid group, or sulfonic acid group.

9. A electrophotographic image forming apparatus, at least comprising:

a charging unit which charges an electrophotographic photoreceptor;

an exposing unit;

a developing unit; and a transfer unit, wherein the electrophotographic photoreceptor comprises a conductive support and a photosensitive layer and a surface protection layer that are sequentially laminated on the conductive support, and wherein the surface protection layer contains a binder resin and inorganic fine particles surface-treated with a hole transporting compound of the following General Formula 1, $$A\text{-}(R_1\text{-}Q_1)_k \qquad \text{[General Formula 1]}$$

where A is a hole transporting group; $Q_1$ is an acidic group; $R_1$ is a substituted or non-substituted alkylene, alkenylene or arylene group; k is a positive integer of 1 or more; and if k is an integer of 2 or more, each of $R_1$ and $Q_1$ are same or different.

10. A process cartridge for an electrophotographic image forming apparatus that at least comprises a charging unit which charges an electrophotographic photoreceptor, an exposing unit, a developing unit and a transfer unit, the process cartridge at least comprising:

the electrophotographic photoreceptor; and at least one of the charging unit, the exposing unit and the developing unit that is integrally formed with the electrophotographic photoreceptor, wherein the process cartridge is attachable to the electrophotographic image forming apparatus, wherein the electrophotographic photoreceptor comprises a conductive support and a photosensitive layer and a surface protection layer that are sequentially laminated on the conductive support, and wherein the surface protection layer contains a binder resin and inorganic fine particles surface-treated with a hole transporting compound of the following General Formula 1, $$A\text{-}(R_1\text{-}Q_1)_k \qquad \text{[General Formula 1]}$$

where A is a hole transporting group; $Q_1$ is an acidic group; $R_1$ is a substituted or non-substituted alkylene, alkenylene or arylene group; k is a positive integer of 1 or more; and if k is an integer of 2 or more, each of $R_1$ and $Q_1$ are same or different.

* * * * *